US011820575B2

(12) United States Patent
Aramaki et al.

(10) Patent No.: US 11,820,575 B2
(45) Date of Patent: Nov. 21, 2023

(54) SUBSTRATE STORING CONTAINER, METHOD FOR MANUFACTURING THE SAME, AND FILTER UNIT

(71) Applicant: MIRAIAL CO., LTD., Tokyo (JP)

(72) Inventors: Kazuhiko Aramaki, Tokyo (JP); Yuya Narita, Tokyo (JP)

(73) Assignee: MIRAIAL CO., LTD., Tokyo (JP)

( * ) Notice: Subject to any disclaimer, the term of this patent is extended or adjusted under 35 U.S.C. 154(b) by 2 days.

(21) Appl. No.: 17/598,701

(22) PCT Filed: Oct. 23, 2020

(86) PCT No.: PCT/JP2020/039851

§ 371 (c)(1),
(2) Date: Sep. 27, 2021

(87) PCT Pub. No.: WO2021/181742

PCT Pub. Date: Sep. 16, 2021

(65) Prior Publication Data

US 2022/0161985 A1 May 26, 2022

(51) Int. Cl.

| | |
|---|---|
| ***B65D 81/18*** | (2006.01) |
| ***B65D 81/05*** | (2006.01) |
| ***B65D 85/30*** | (2006.01) |

(52) U.S. Cl.

CPC ..... *B65D 81/18* (2013.01); *B65D 81/05* (2013.01); *B65D 85/30* (2013.01); *B65D 2581/051* (2013.01)

(58) Field of Classification Search

CPC ..... B65D 81/05; B65D 81/18; B65D 85/30; B65D 2581/051; H01L 21/673;

(Continued)

(56) References Cited

U.S. PATENT DOCUMENTS 7,455,180 B2 * 11/2008 Sumi ..... H01L 21/67379 206/711
7,648,041 B2 * 1/2010 Ueda ..... H01L 21/67376 206/710

(Continued)

FOREIGN PATENT DOCUMENTS

JP 4204302 B2 5/2004
JP 4859065 B2 5/2009

(Continued)

*Primary Examiner* — Bryon P Gehman

(74) *Attorney, Agent, or Firm* — Muncy, Geissler, Olds & Lowe, P.C.

(57) ABSTRACT

A substrate storing container includes a filter unit having a housing that forms a ventilation path and a filter. The housing includes an outer housing portion and an inner housing portion at least partially disposed inside the outer housing portion and fastened to the outer housing portion. The inner housing portion has a male thread portion at a part disposed inside the outer housing portion. The outer housing portion has a female thread portion that meshes with the male thread portion. The inner housing portion has first engagement portions at a part that is disposed inside the outer housing portion and where the male thread portion does not exist. The outer housing portion has second engagement portions that engage with the first engagement portions at a part where the female thread portion does not exist. The first engagement portions and the second engagement portions are configured to be visually identifiable.

5 Claims, 16 Drawing Sheets

(58) Field of Classification Search
CPC ..... H01L 21/67366; H01L 21/67376; H01L 21/67383; H01L 21/67386; H01L 21/67389; H01L 21/677; H01L 21/67772
USPC ..... 206/710–714
See application file for complete search history.

(56) References Cited

U.S. PATENT DOCUMENTS

| | | | | |
|---|---|---|---|---|
| 10,923,373 | B2 * | 2/2021 | Ogawa | H01L 21/67379 |
| 10,985,043 | B2 * | 4/2021 | Narita | H01L 21/67383 |
| 11,011,399 | B2 * | 5/2021 | Matsutori | H01L 21/67393 |
| 11,230,427 | B2 * | 1/2022 | Ogawa | H01L 21/67376 |
| 2018/0308733 | A1 | 10/2018 | Kasama et al. | |
| 2018/0358251 | A1 | 12/2018 | Narita | |
| 2020/0386334 | A1 | 12/2020 | Matsutori et al. | |

FOREIGN PATENT DOCUMENTS

| | | | |
|---|---|---|---|
| JP | 2009-246154 | A | 10/2009 |
| JP | 2016-096184 | A | 5/2016 |
| TW | 201625347 | A | 7/2016 |
| TW | 201724327 | A | 7/2017 |
| WO | WO 2019/159369 | A | 8/2019 |

* cited by examiner

SUBSTRATE STORING CONTAINER, METHOD FOR MANUFACTURING THE SAME, AND FILTER UNIT

TECHNICAL FIELD

The present invention relates to a substrate storing container used when a substrate made of a semiconductor wafer or the like is stored, kept, transferred, transported, or the like, a method for manufacturing the same, and a filter unit provided in the substrate storing container.

BACKGROUND ART

Known in the related art is a substrate storing container configured to include a container main body and a lid body in order to store a substrate made of a semiconductor wafer and transfer the substrate in a process in a factory.

One end portion of the container main body has an opening circumferential portion with a container main body opening portion formed. The other end portion of the container main body has a blocked tubular wall portion. A substrate storing space is formed in the container main body. The substrate storing space is surrounded by the wall portion and can store substrates. The lid body can be attached to and detached from the opening circumferential portion and is capable of blocking the container main body opening portion. Side substrate support portions are provided in the wall portion so as to make a pair in the substrate storing space. The side substrate support portions are capable of supporting the edge portions of substrates in a state where the adjacent substrates are separated from each other at a predetermined interval and arranged in parallel when the container main body opening portion is not blocked by the lid body.

A front retainer is provided at the part of the lid body that faces the substrate storing space when the container main body opening portion is blocked. The front retainer is capable of supporting the edge portions of the substrates when the container main body opening portion is blocked by the lid body. A back side substrate support portion is provided in the wall portion so as to make a pair with the front retainer. The back side substrate support portion is capable of supporting the edge portions of the substrates. When the container main body opening portion is blocked by the lid body, the back side substrate support portion supports the substrates in cooperation with the front retainer. As a result, the back side substrate support portion retains the substrates in a state where the adjacent substrates are separated from each other at a predetermined interval and arranged in parallel.

A substrate storing container includes a "filter unit having a ventilation path capable of allowing communication between a substrate storing space and a space outside a container main body, a filter disposed in the ventilation path, and a housing that forms the ventilation path, the filter unit being disposed in the container main body, in which gas can pass between the space outside the container main body and the substrate storing space through the filter" (e.g., see Patent Documents 1 and 2). For example, the housing includes an outer housing portion and an inner housing portion at least partially disposed inside the outer housing portion and fastened to the outer housing portion. The inner housing portion has a male thread portion at a part disposed inside the outer housing portion, and the outer housing portion has a female thread portion that meshes with the male thread portion. The inner housing portion and the outer housing portion are fastened by a torque wrench with a predetermined fastening torque set.

Patent Document 1: Japanese Patent No. 4859065

Patent Document 2: Japanese Patent No. 4204302

DISCLOSURE OF THE INVENTION

Problems to be Solved by the Invention

However, it may not be possible to achieve normal fastening by controlling the fastening torque alone. For example, in the process of fastening, due to some defects (e.g., when the set torque of the torque wrench has been set incorrectly low or when a part of the inner housing portion has bitten a part of the outer housing portion), it is impossible to complete the fastening to a normal fastening position. Also, although once placed in a normal fastening position, due to some circumstances (e.g., when one of the inner housing portion or the outer housing portion is unintentionally rotated in the loosening direction), the fastening may be loosened. In such a case, it is difficult to confirm whether the fastening position is normal.

An object of the present invention is to provide a substrate storing container including a filter unit having a ventilation path capable of allowing communication between a substrate storing space and a space outside a container main body, a filter disposed in the ventilation path, and a housing that forms the ventilation path, in which the housing includes an outer housing portion, and an inner housing portion at least partially disposed inside the outer housing portion and fastened to the outer housing portion, and it can be easily confirmed whether the fastening position is normal. It is another object of the present invention to provide a method for manufacturing the substrate storing container, and the filter unit provided in the substrate storing container.

Means for Solving the Problems

The present invention relates to a substrate storing container, including a container main body, a lid body, a sealing member, and a filter unit. The container main body includes a tubular wall portion in which an opening circumferential portion with a container main body opening portion formed is provided in one end portion and the other end portion is blocked. An inner face of the wall portion forms a substrate storing space that can store a substrate and communicates with the container main body opening portion. The lid body can be attached to and detached from the opening circumferential portion and can block the container main body opening portion with a positional relationship surrounded by the opening circumferential portion. The sealing member is attached to the lid body and can abut against the lid body and the opening circumferential portion, and blocks the container main body opening portion in cooperation with the lid body by being interposed between the opening circumferential portion and the lid body and coming into close contact with and abutting against the opening circumferential portion and the lid body. The filter unit has a ventilation path capable of allowing communication between the substrate storing space and a space outside the container main body, a filter disposed in the ventilation path, and a housing that forms the ventilation path. The filter unit is disposed in the container main body, and gas can pass between the space outside the container main body and the substrate storing space through the filter. The housing includes an outer housing portion, and an inner housing portion at least partially disposed inside the outer housing portion and fastened to the outer housing portion. The inner housing portion has a male thread portion at a part disposed inside the outer housing portion. The outer housing portion has a female thread portion that meshes with the male thread portion. The inner housing portion has a first engagement portion at a part that is disposed inside the outer housing portion and where the male thread portion does not exist. The outer housing portion has a second engagement portion, which engages with the first engagement portion, at a part where the female thread portion does not exist. The first engagement portion and the second engagement portion are configured to be visually identifiable in fastening of the inner housing portion and the outer housing portion.

The outer housing portion is preferably configured such that the first engagement portion and the second engagement portion are visually identifiable in a range that includes the second engagement portion and that is a circumferential range around a rotation axis of the female thread portion.

The present invention relates to a method for manufacturing the substrate storing container. The housing further includes an inner component joined to the inner housing portion on a side of the substrate storing space with the filter sandwiched between them. The inner housing portion and the outer housing portion are fastened to each other by rotating the outer housing portion with the inner housing portion fixed.

The present invention relates to a filter unit disposed in a container main body of a substrate storing container. The substrate storing container includes the container main body, a lid body, and a sealing member. The container main body includes a tubular wall portion in which an opening circumferential portion with a container main body opening portion formed is provided in one end portion and the other end portion is blocked. An inner face of the wall portion forms a substrate storing space that can store a substrate and communicates with the container main body opening portion. The lid body can be attached to and detached from the opening circumferential portion and can block the container main body opening portion with a positional relationship surrounded by the opening circumferential portion. The sealing member is attached to the lid body and can abut against the lid body and the opening circumferential portion, and blocks the container main body opening portion in cooperation with the lid body by being interposed between the opening circumferential portion and the lid body and coming into close contact with and abutting against the opening circumferential portion and the lid body. The filter unit has a filter disposed in a ventilation path capable of allowing communication between the substrate storing space and a space outside the container main body, and a housing that forms the ventilation path. The filter unit is disposed in the container main body, and gas can pass between the space outside the container main body and the substrate storing space through the filter. The housing includes an outer housing portion, and an inner housing portion at least partially disposed inside the outer housing portion and fastened to the outer housing portion. The inner housing portion has a male thread portion at a part disposed inside the outer housing portion. The outer housing portion has a female thread portion that meshes with the male thread portion. The inner housing portion has a first engagement portion at a part that is disposed inside the outer housing portion and where the male thread portion does not exist. The outer housing portion has a second engagement portion, which engages with the first engagement portion, at a part where the female thread portion does not exist. The first engagement portion and the second engagement portion are configured to be visually identifiable in fastening of the inner housing portion and the outer housing portion.

The outer housing portion is preferably configured such that the first engagement portion and the second engagement portion are visually identifiable in a range that includes the second engagement portion and that is a circumferential range around a rotation axis of the female thread portion.

Effects of the Invention

According to the present invention, it is possible to provide a substrate storing container including a filter unit having an ventilation path capable of allowing communication between a substrate storing space and a space outside a container main body, a filter disposed in the ventilation path, and a housing that forms the ventilation path, in which the housing includes an outer housing portion, and an inner housing portion at least partially disposed inside the outer housing portion and fastened to the outer housing portion, and it can be easily confirmed whether the fastening position is normal. In addition, the present invention can provide a method for manufacturing the substrate storing container, and the filter unit.

PREFERRED MODE FOR CARRYING OUT THE INVENTION

[Overall Configuration of Substrate Storing Container 1]

Figure 1:
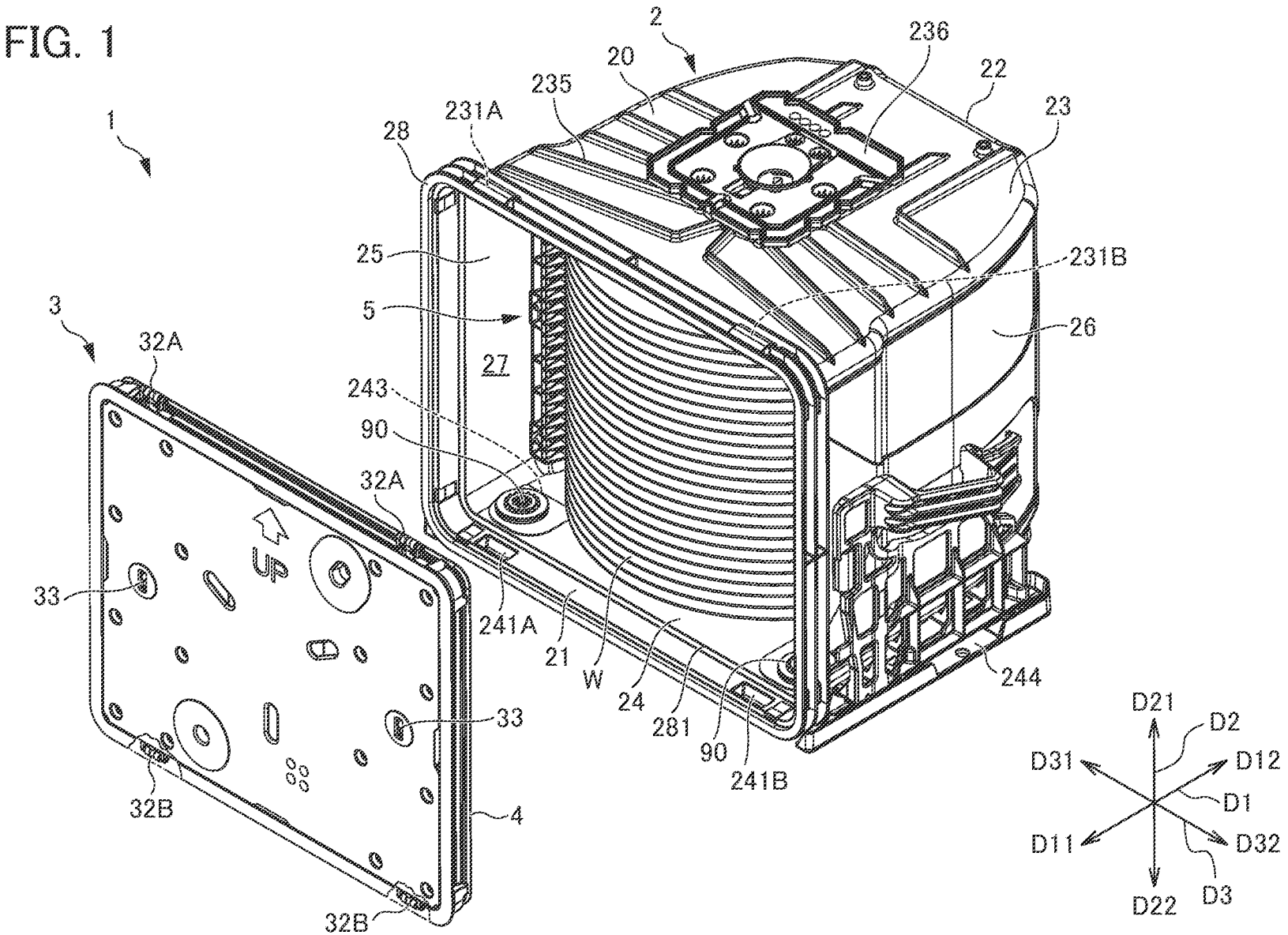
FIG. 1 is an exploded perspective view illustrating a state where a plurality of substrates W are stored in a substrate storing container 1 according to an embodiment of the present invention.
Figure 2:
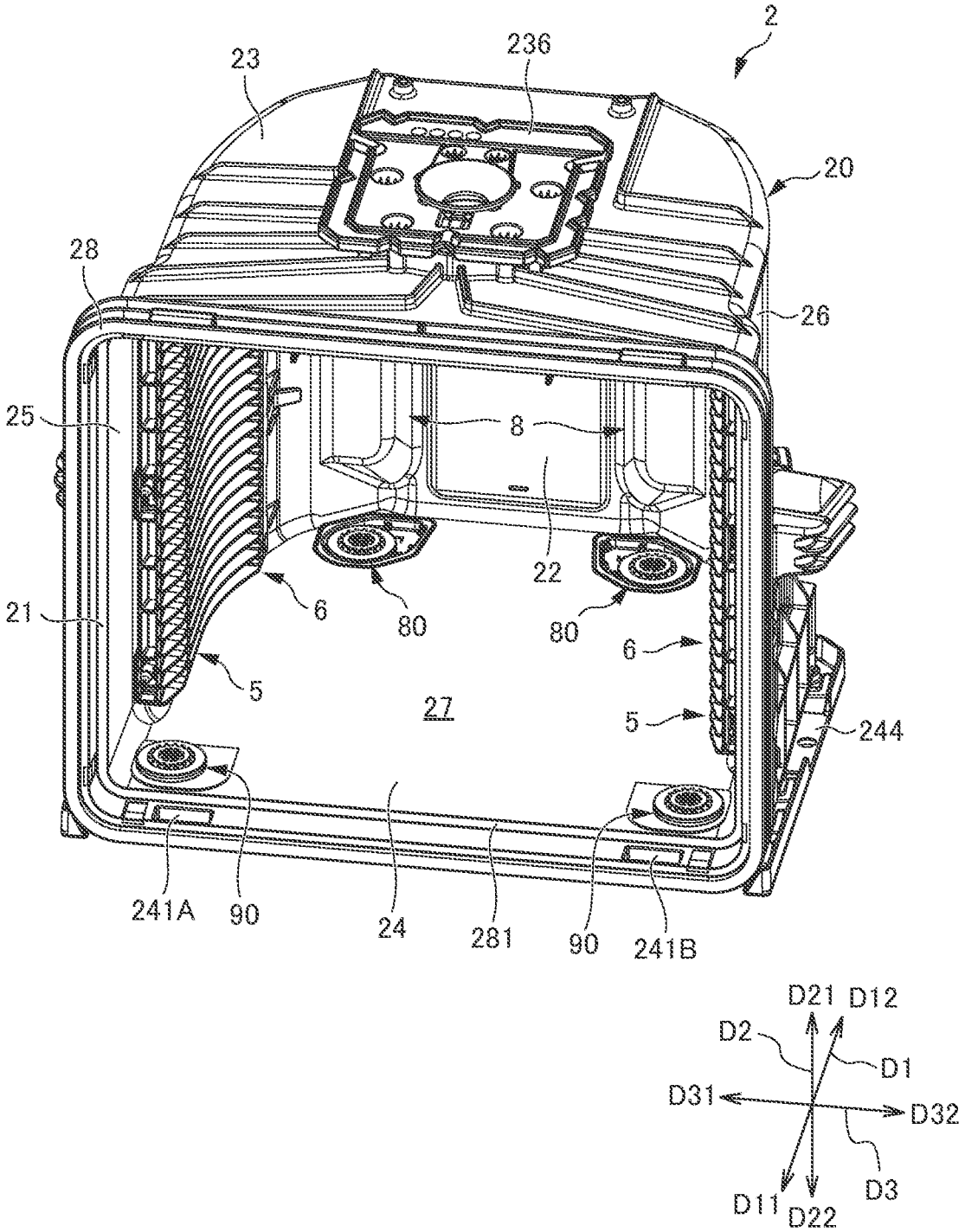
FIG. 2 is an upper perspective view illustrating a container main body 2 of the substrate storing container 1 according to the embodiment of the present invention.
Figure 3:
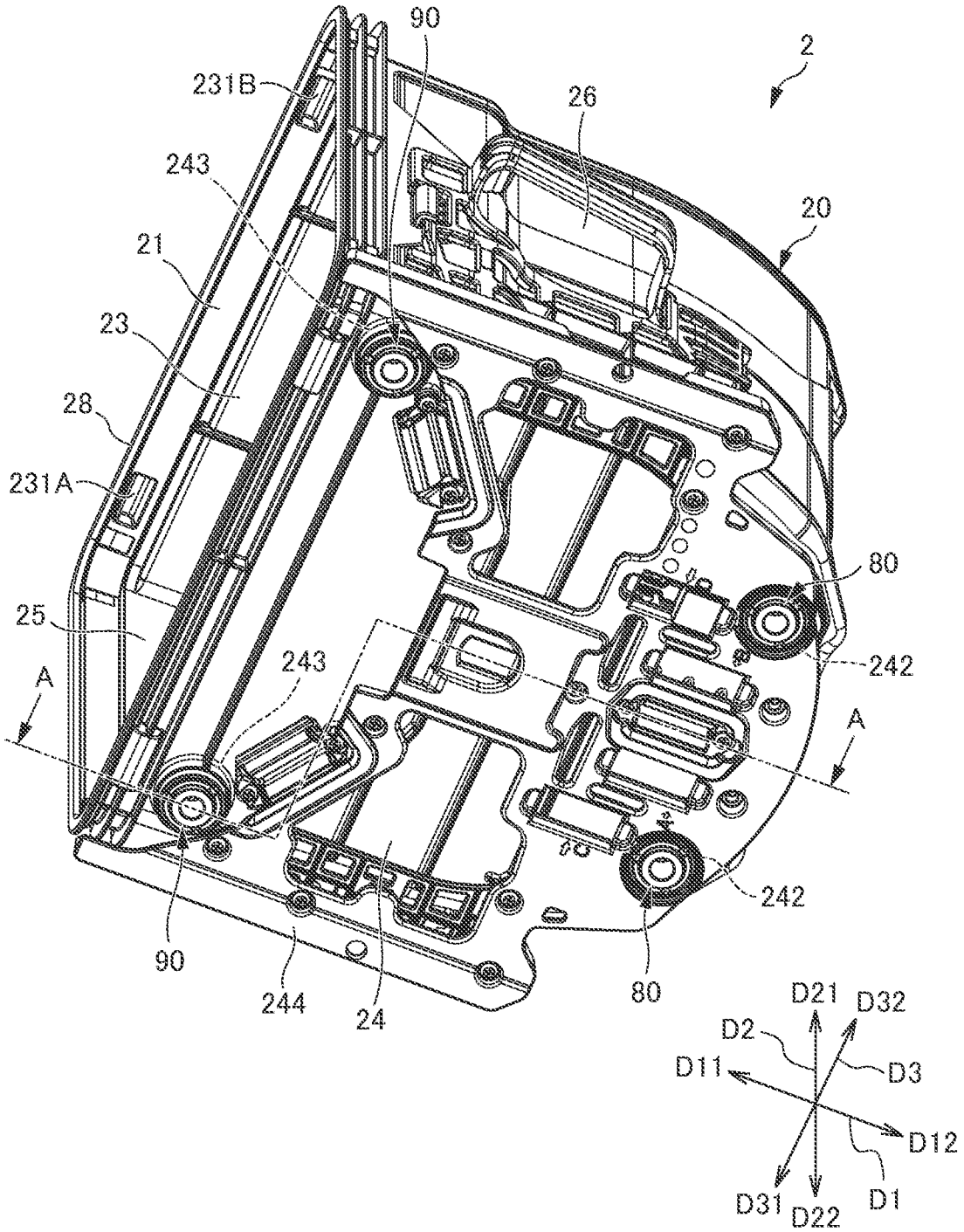
FIG. 3 is a lower perspective view illustrating the container main body 2 of the substrate storing container 1 according to the embodiment of the present invention.
Figure 4:
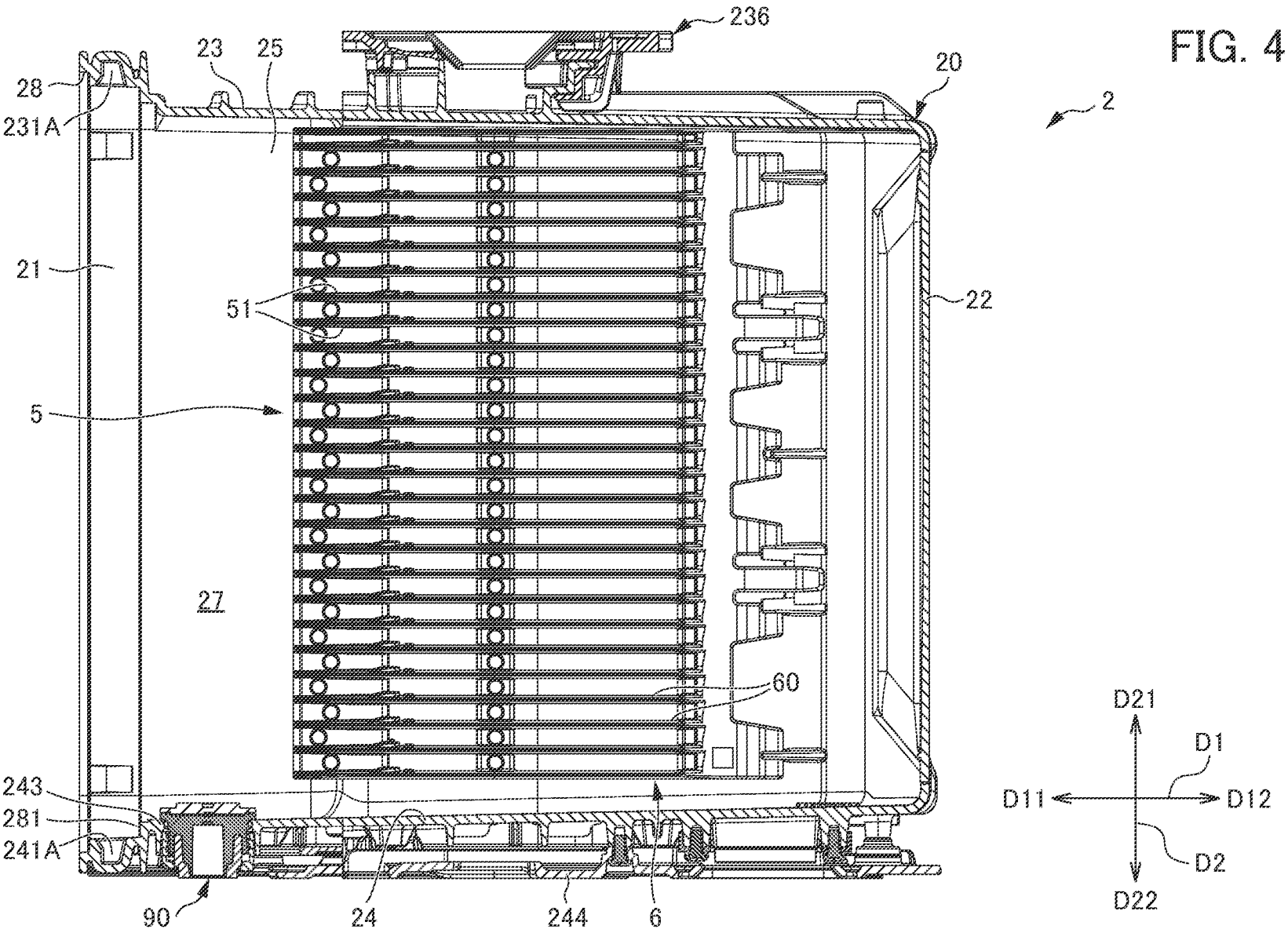
FIG. 4 is a side cross-sectional view illustrating the container main body 2 taken along line A-A in FIG. 3.

Hereinafter, a substrate storing container 1 according to the present embodiment will be described with reference to the drawings. FIG. 1 is an exploded perspective view illustrating a state where a plurality of substrates W are stored in the substrate storing container 1. FIG. 2 is an upper perspective view illustrating a container main body 2 of the substrate storing container 1. FIG. 3 is a lower perspective view illustrating the container main body 2 of the substrate storing container 1. FIG. 4 is a side cross-sectional view illustrating the container main body 2 taken along line A-A in FIG. 3.

Here, for convenience of description, the direction from the container main body 2 (described later) toward a lid body 3 (direction from the upper right toward the lower left in FIG. 1) is defined as the forward direction D11, the direction opposite to the forward direction is defined as the backward direction D12, and the forward and backward directions are collectively defined as the forward/backward direction D1. In addition, the direction from a lower wall 24 (described later) toward an upper wall 23 (upper direction in FIG. 1) is defined as the upper direction D21, the direction opposite to the upper direction is defined as the lower direction D22, and the upper and lower directions are collectively defined as the upper/lower direction D2. In addition, the direction from a second side wall 26 (described later) toward a first side wall 25 (direction from the lower right toward the upper left in FIG. 1) is defined as the left direction D31, the direction opposite to the left direction is defined as the right direction D32, and the left and right directions are collectively defined as the left/right direction D3. The main drawings illustrate arrows indicating these directions.

In addition, the substrate W (see FIG. 1) stored in the substrate storing container 1 is a disk-shaped silicon wafer, a disk-shaped glass wafer, a disk-shaped sapphire wafer, or the like, is thin, and is used in industries. The substrate W in the present embodiment is a silicon wafer having a diameter of 300 mm.

As illustrated in FIGS. 1 to 4, the substrate storing container 1 stores the substrate W made of a silicon wafer described above and is used as an in-process container for transferring the substrate W in a process in a factory and used as a shipping container for transporting a substrate by means of transport such as means of transport by land, air, and sea. The substrate storing container 1 includes the container main body 2 and the lid body 3. The container main body 2 includes substrate support plate-like portions 5 as side substrate support portions, and a back side substrate support portion 6. The lid body 3 includes a front retainer (not illustrated) as a lid body side substrate support portion.

The container main body 2 has a tubular wall portion 20. A container main body opening portion 21 is formed in one end portion of the wall portion 20. The other end portion of the wall portion 20 is blocked. A substrate storing space 27 is formed in the container main body 2. The substrate storing space 27 is formed so as to be surrounded by the wall portion 20. The substrate support plate-like portion 5 is disposed at the part of the wall portion 20 that forms the substrate storing space 27. A plurality of the substrates W can be stored in the substrate storing space 27 as illustrated in FIG. 1.

The substrate support plate-like portions 5 are provided in the wall portion 20 so as to make a pair in the substrate storing space 27. The substrate support plate-like portions 5 are capable of supporting the edge portions of the plurality of substrates W in a state where the adjacent substrates W are separated from each other at a predetermined interval and arranged in parallel by abutting against the edge portions of the plurality of substrates W. The back side substrate support portion 6 is provided by being integrally molded with the substrate support plate-like portions 5 on the back side of the substrate support plate-like portions 5.

The back side substrate support portion 6 is provided in the wall portion 20 so as to make a pair with the front retainer (described later, not illustrated) in the substrate storing space 27. The back side substrate support portion 6 is capable of supporting the rear portions of the edge portions of the plurality of substrates W by abutting against the edge portions of the plurality of substrates W.

The lid body 3 can be attached to and detached from an opening circumferential portion 28 forming the container main body opening portion 21 and is capable of blocking the container main body opening portion 21. The front retainer (not illustrated) is provided at the part of the lid body 3 that faces the substrate storing space 27 when the container main body opening portion 21 is blocked by the lid body 3. The front retainer is disposed so as to make a pair with the back side substrate support portion 6 in the substrate storing space 27.

When the container main body opening portion 21 is blocked by the lid body 3, the front retainer is capable of supporting the front portions of the edge portions of the plurality of substrates W by abutting against the edge portions of the plurality of substrates W. When the container main body opening portion 21 is blocked by the lid body 3, the front retainer retains the plurality of substrates W in a state where the adjacent substrates W are separated from each other at a predetermined interval and arranged in parallel by supporting the plurality of substrates W in cooperation with the back side substrate support portion 6.

A resin such as a plastic material constitutes the substrate storing container 1. Unless otherwise specified, examples of the resin of the material include thermoplastic resins such as polycarbonates, cycloolefin polymers, polyetherimide, polyetherketone, polybutylene terephthalate, polyether ether ketone, and liquid crystal polymers and alloys thereof. A conductive substance such as a carbon fiber, carbon powder, a carbon nanotube, and a conductive polymer is selectively added to the resins of the molding materials in a case where conductivity is to be added. It is also possible to add a glass fiber, a carbon fiber, or the like for the purpose of rigidity enhancement.

[Container Main Body 2]

Hereinafter, each portion will be described in detail. As illustrated in FIGS. 1 to 4, the wall portion 20 of the container main body 2 has a back wall 22, the upper wall 23, the lower wall 24, the first side wall 25, and the second side wall 26. The back wall 22, the upper wall 23, the lower wall 24, the first side wall 25, and the second side wall 26 are constituted by the material described above and are configured by being integrally molded.

The first side wall 25 and the second side wall 26 face each other. The upper wall 23 and the lower wall 24 face each other. The rear edge of the upper wall 23, the rear edge of the lower wall 24, the rear edge of the first side wall 25, and the rear edge of the second side wall 26 are connected to the back wall 22 without exception. The front edge of the upper wall 23, the front edge of the lower wall 24, the front edge of the first side wall 25, and the front edge of the second side wall 26 constitute the opening circumferential portion 28 forming the substantially rectangular container main body opening portion 21.

The opening circumferential portion 28 is provided in one end portion of the container main body 2. The back wall 22 is positioned in the other end portion of the container main body 2. The profile of the container main body 2 formed by the outer faces of the wall portion 20 is a box shape. The inner face of the wall portion 20, that is, the inner face of the back wall 22, the inner face of the upper wall 23, the inner face of the lower wall 24, the inner face of the first side wall 25, and the inner face of the second side wall 26 form the substrate storing space 27 surrounded by the inner faces. The container main body opening portion 21 formed in the opening circumferential portion 28 communicates with the substrate storing space 27 surrounded by the wall portion 20 and formed in the container main body 2. A maximum of 25 substrates W can be stored in the substrate storing space 27.

Latch engagement concave portions 231A, 231B, 241A, and 241B concaved outward from the substrate storing space 27 are formed at parts of the upper wall 23 and the lower wall 24 near the opening circumferential portion 28. A total of four latch engagement concave portions 231A, 231B, 241A, and 241B are respectively formed near both right and left end portions of the upper wall 23 and the lower wall 24.

On the outer face of the upper wall 23, a rib 235 is provided by being molded integrally with the upper wall 23. The rib 235 enhances the rigidity of the container main body 2. A top flange 236 is fixed to the middle portion of the upper wall 23. The top flange 236 is a member becoming a part hung and suspended in the substrate storing container 1 when the substrate storing container 1 is suspended in an automatic wafer transfer system (AMHS), a wafer substrate transfer cart (PGV), or the like.

A bottom plate 244 is fixed to the lower wall 24. The bottom plate 244 has a substantially rectangular plate shape disposed to face substantially the entire face of the lower face constituting the outer face of the lower wall 24, and is fixed to the lower wall 24.

In the vicinity of the four corners of the lower wall 24, air supply holes 242 and exhaust holes 243, which are two types of through-holes, are formed. In the present embodiment, the two through-holes in the front of the lower wall 24 are the exhaust holes 243 for discharging the gas in the container main body and the two through-holes in the back of the lower wall 24 are the air supply holes 242 for supplying gas into the container main body.

An air supply filter unit 80 as an additional component is disposed in the through-hole as the air supply hole 242. An exhaust filter unit 90 is disposed in the through-hole as the exhaust hole 243. That is, the flow paths of gas inside the air supply filter unit 80 and the exhaust filter unit 90 constitute a part of ventilation paths capable of allowing communication between the substrate storing space 27 and the space outside the container main body 2. The air supply filter unit 80 and the exhaust filter unit 90 are disposed in the wall portion 20. In the air supply filter unit 80 and the exhaust filter unit 90, gas can pass between the space outside the container main body 2 and the substrate storing space 27. The air supply filter unit 80 is in communication with the inner space of a gas ejection nozzle portion 8. The purge gas supplied to the air supply filter unit 80 through the inner space of the gas ejection nozzle portion 8 is configured to be supplied to the substrate storing space 27.

[Exhaust Filter Unit 90]

Figure 5:
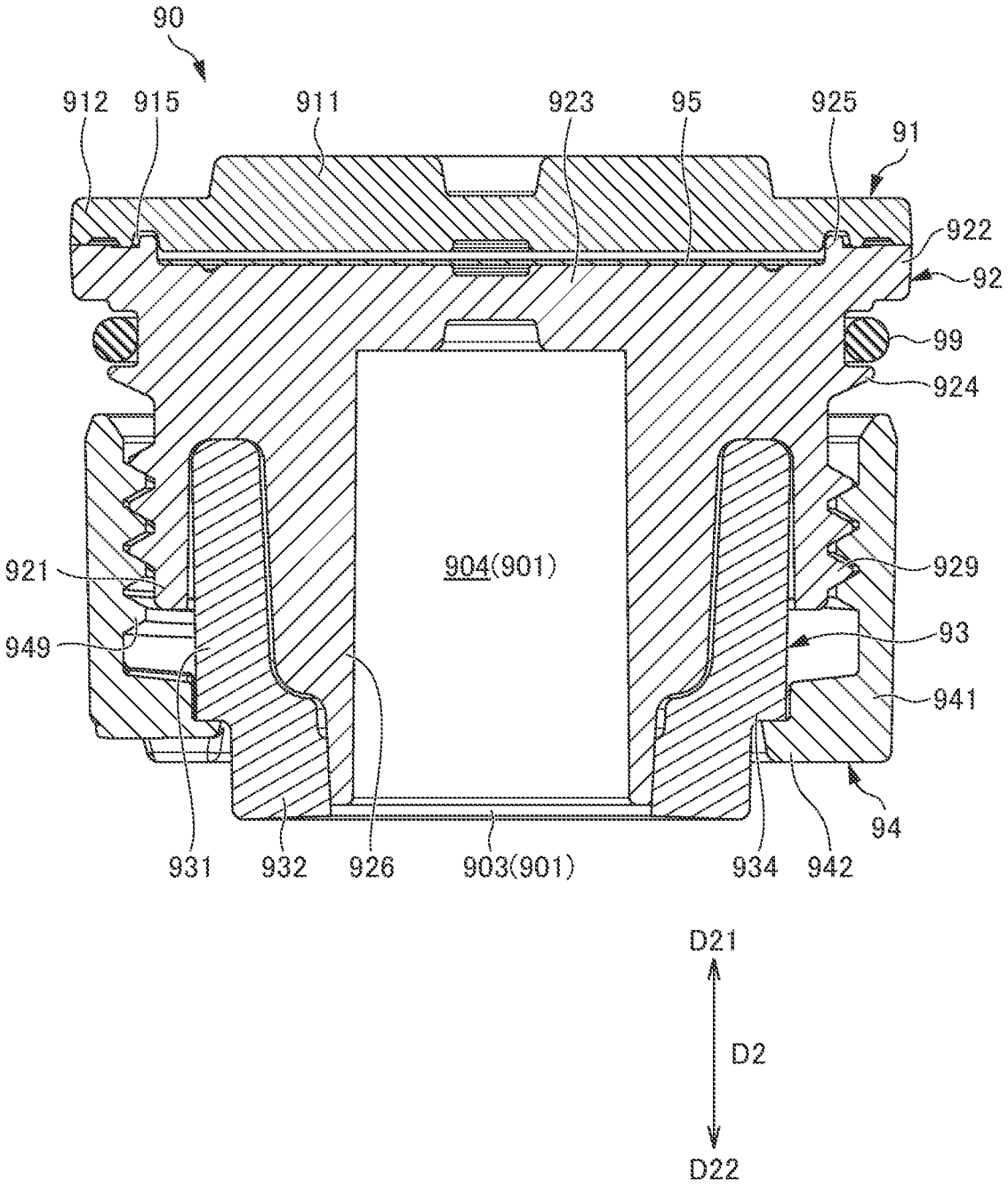
FIG. 5 is a side cross-sectional view illustrating an exhaust filter unit 90 of the substrate storing container 1 according to the embodiment of the present invention.
Figure 6:
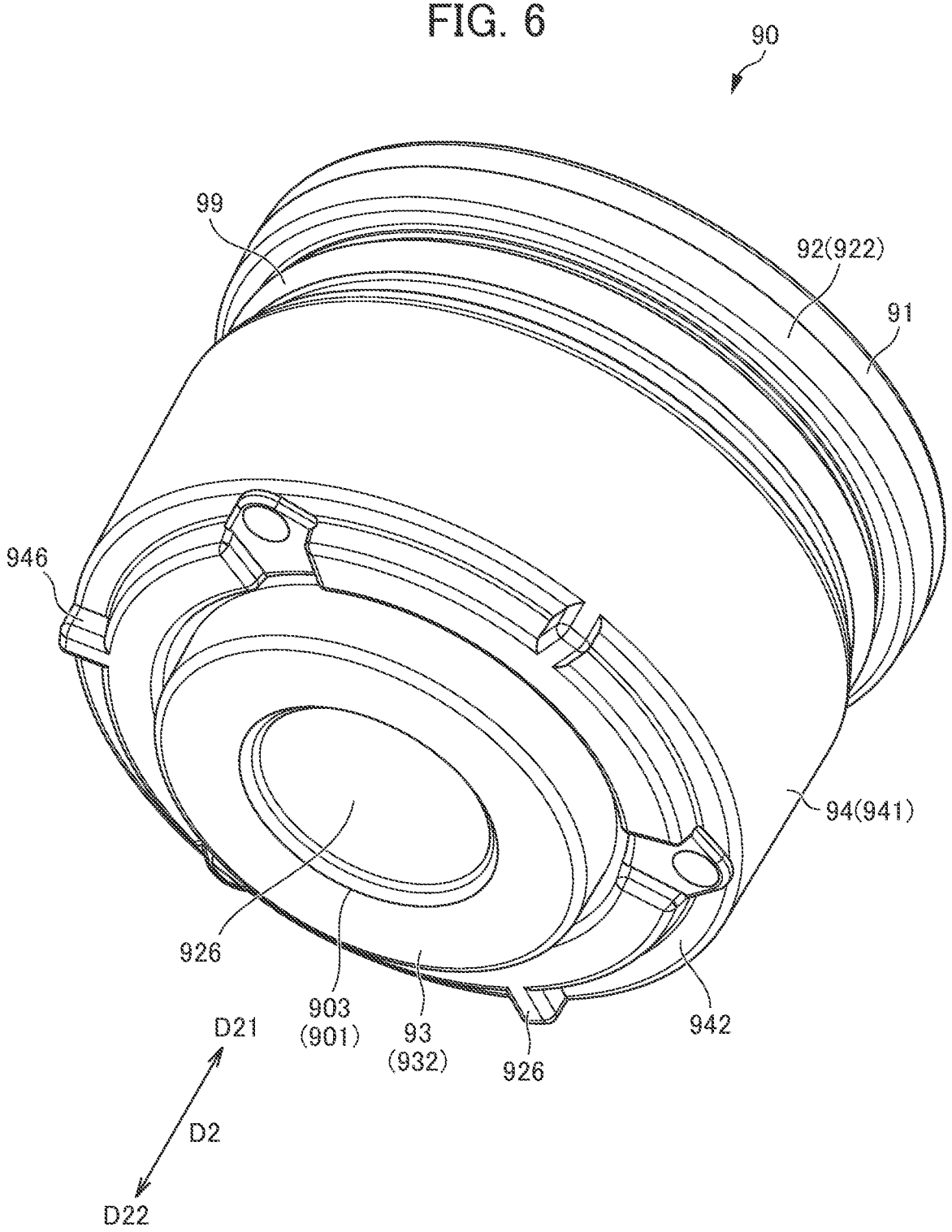
FIG. 6 is a lower perspective view illustrating the exhaust filter unit 90 of the substrate storing container 1 according to the embodiment of the present invention.
Figure 7:
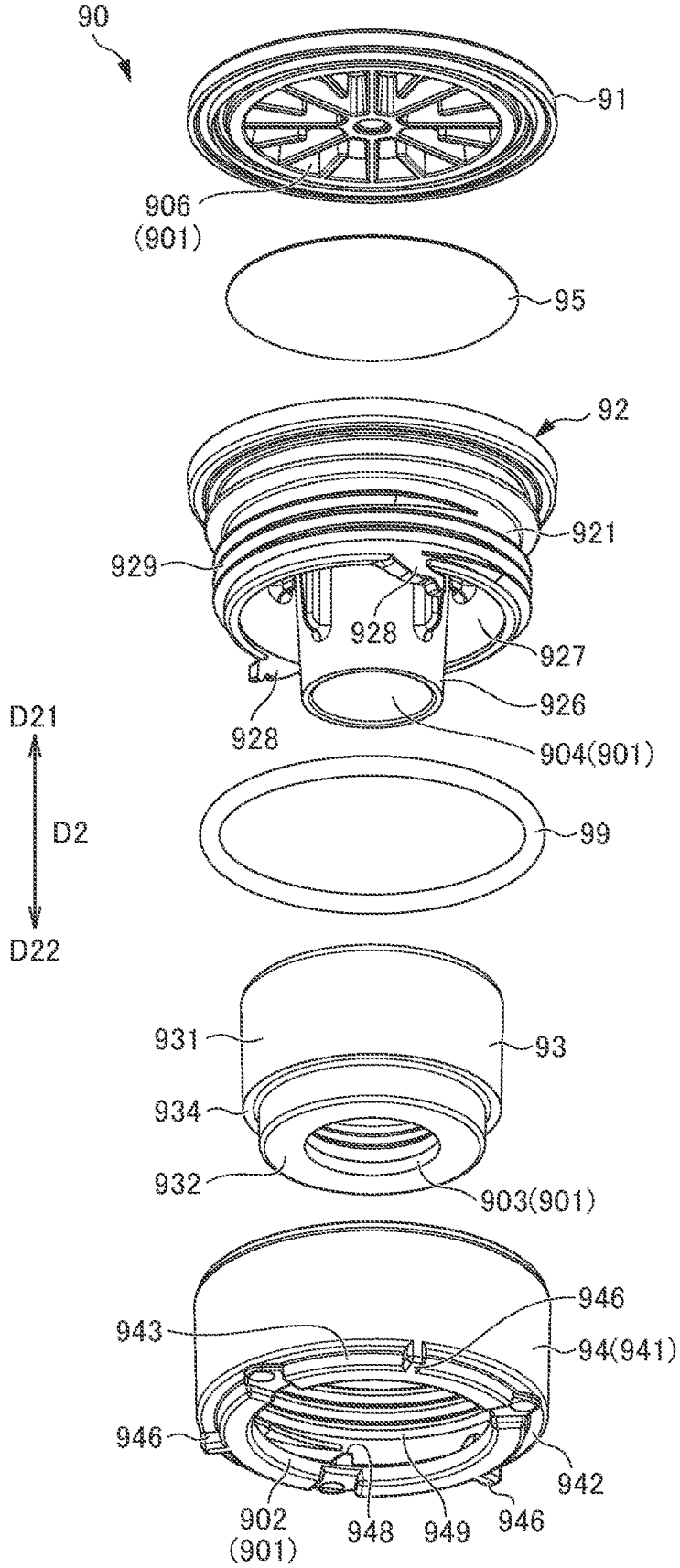
FIG. 7 is an exploded perspective view illustrating the exhaust filter unit 90 of the substrate storing container 1 according to the embodiment of the present invention.
Figure 8:
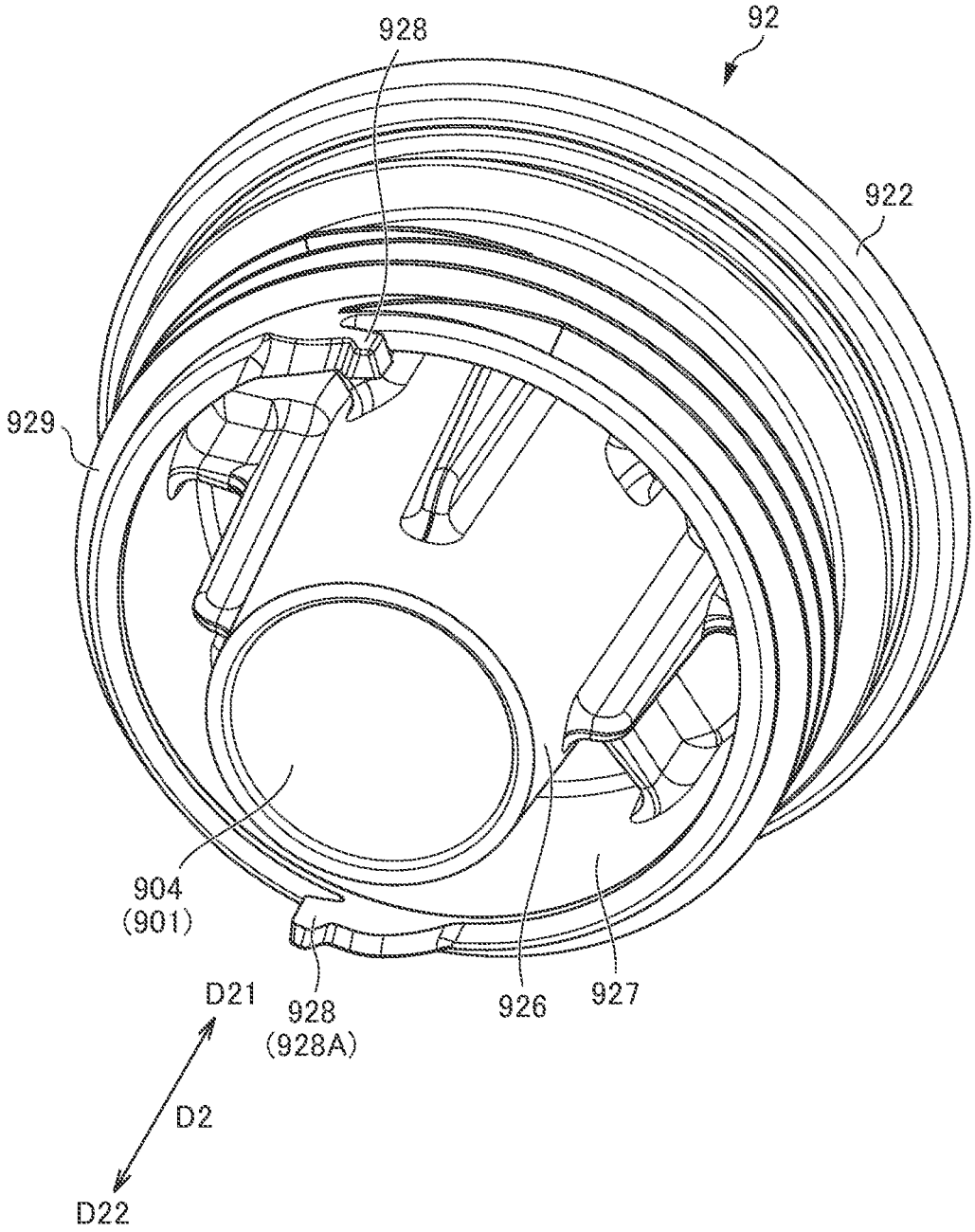
FIG. 8 is a lower perspective view illustrating an inner housing portion 92 of the exhaust filter unit 90.
Figure 9:
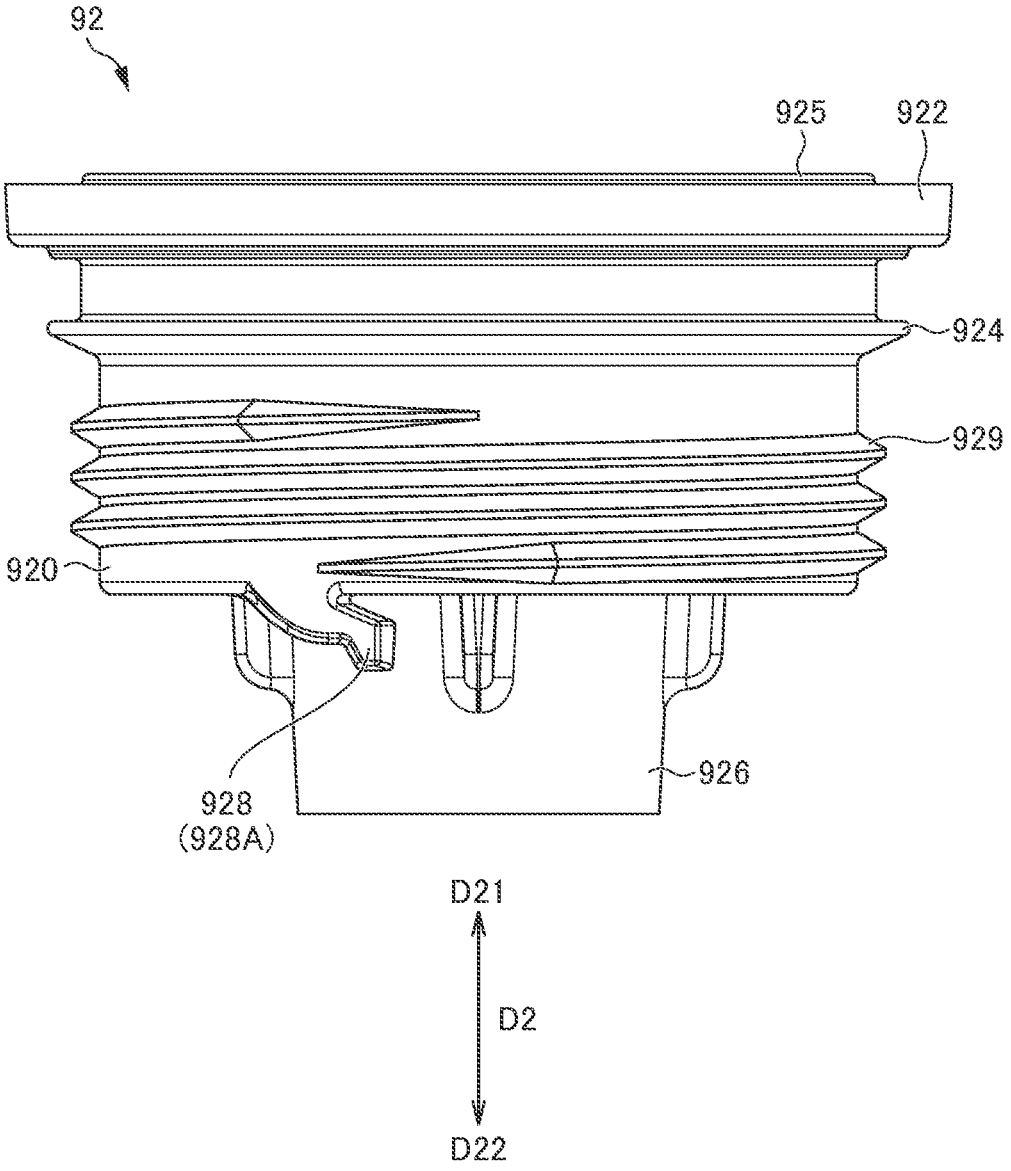
FIG. 9 is a side view illustrating the inner housing portion 92 of the exhaust filter unit 90.
Figure 10:
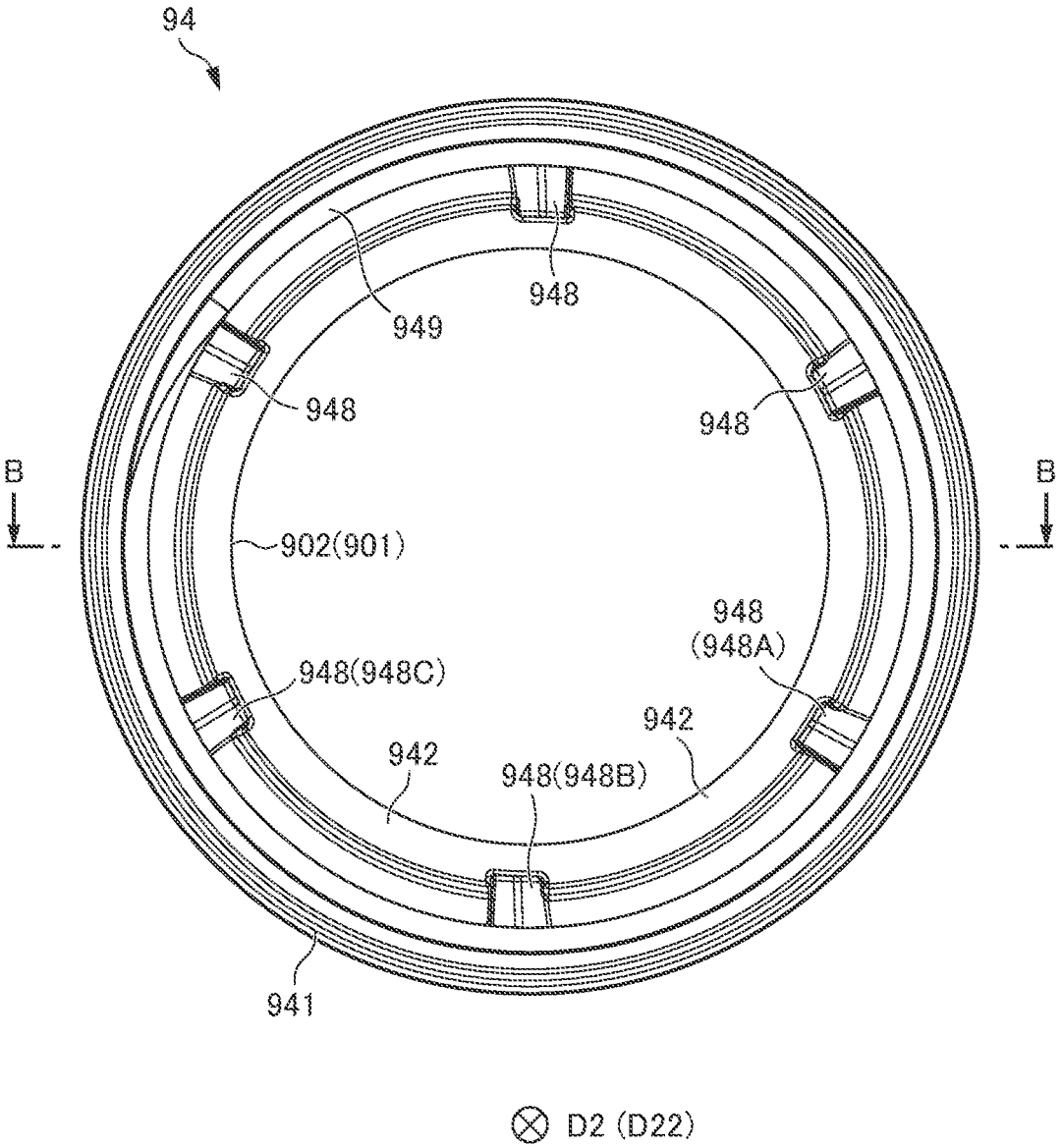
FIG. 10 is a plan view illustrating an outer housing portion 94 of the exhaust filter unit 90.
Figure 11:
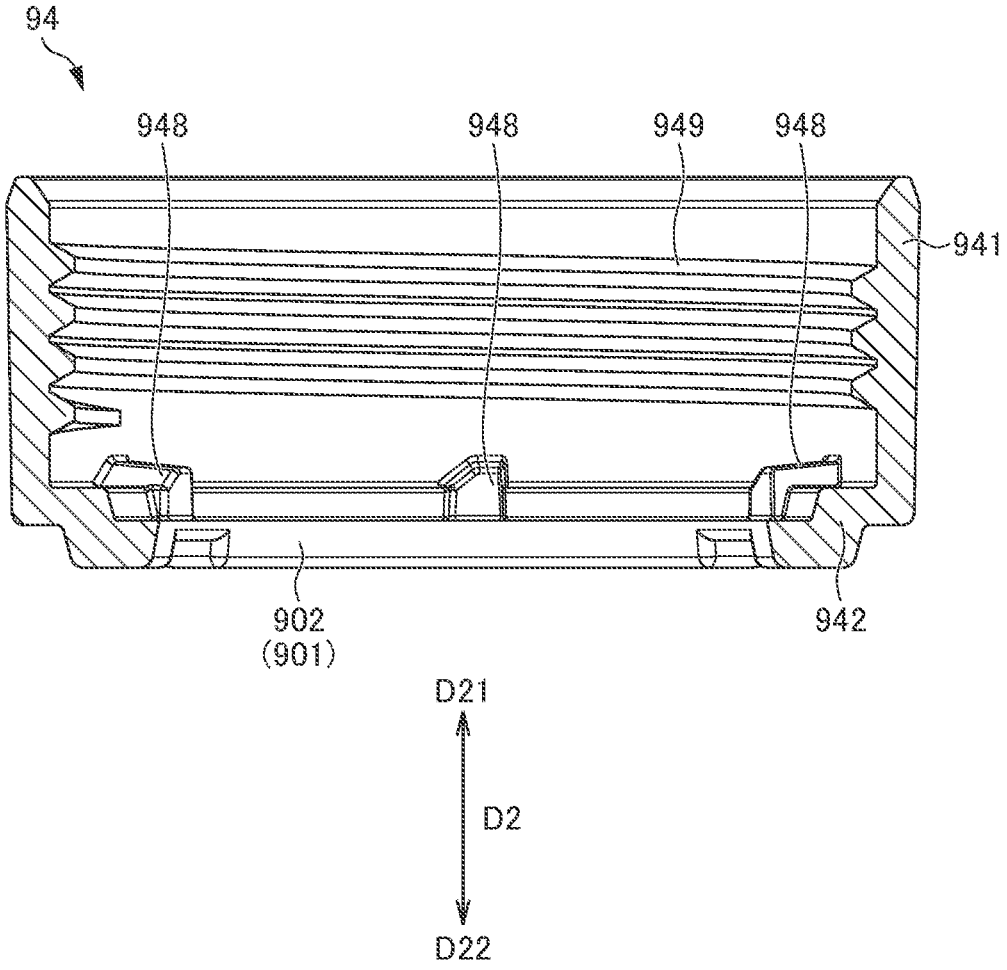
FIG. 11 is a side cross-sectional view illustrating the outer housing portion 94 taken along line B-B in FIG. 10.
Figure 12:
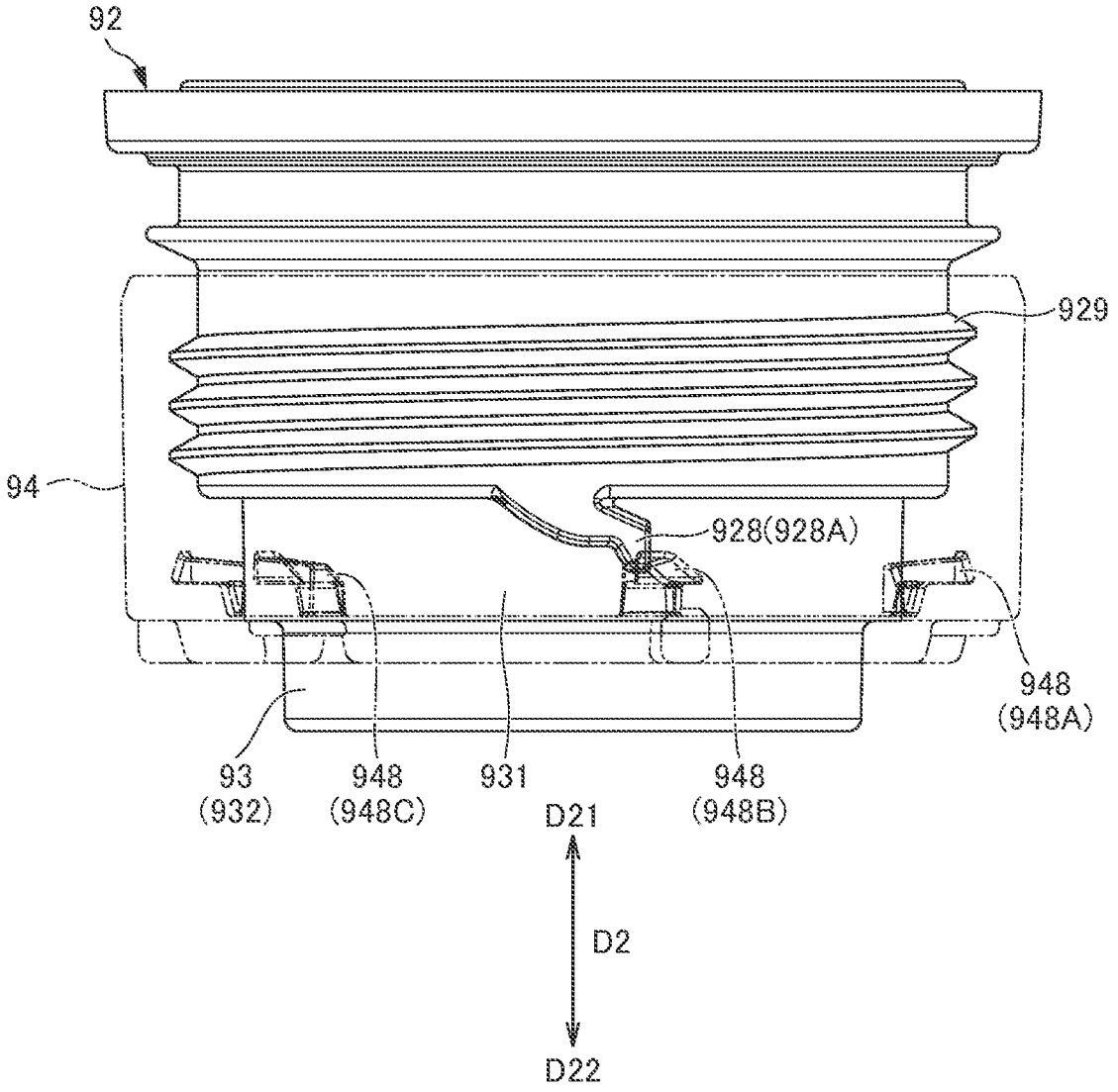
FIG. 12 is a partial transparent side view illustrating a first positional relationship between the inner housing portion 92 and the outer housing portion 94 of the exhaust filter unit 90 in a circumferential direction.
Figure 13:
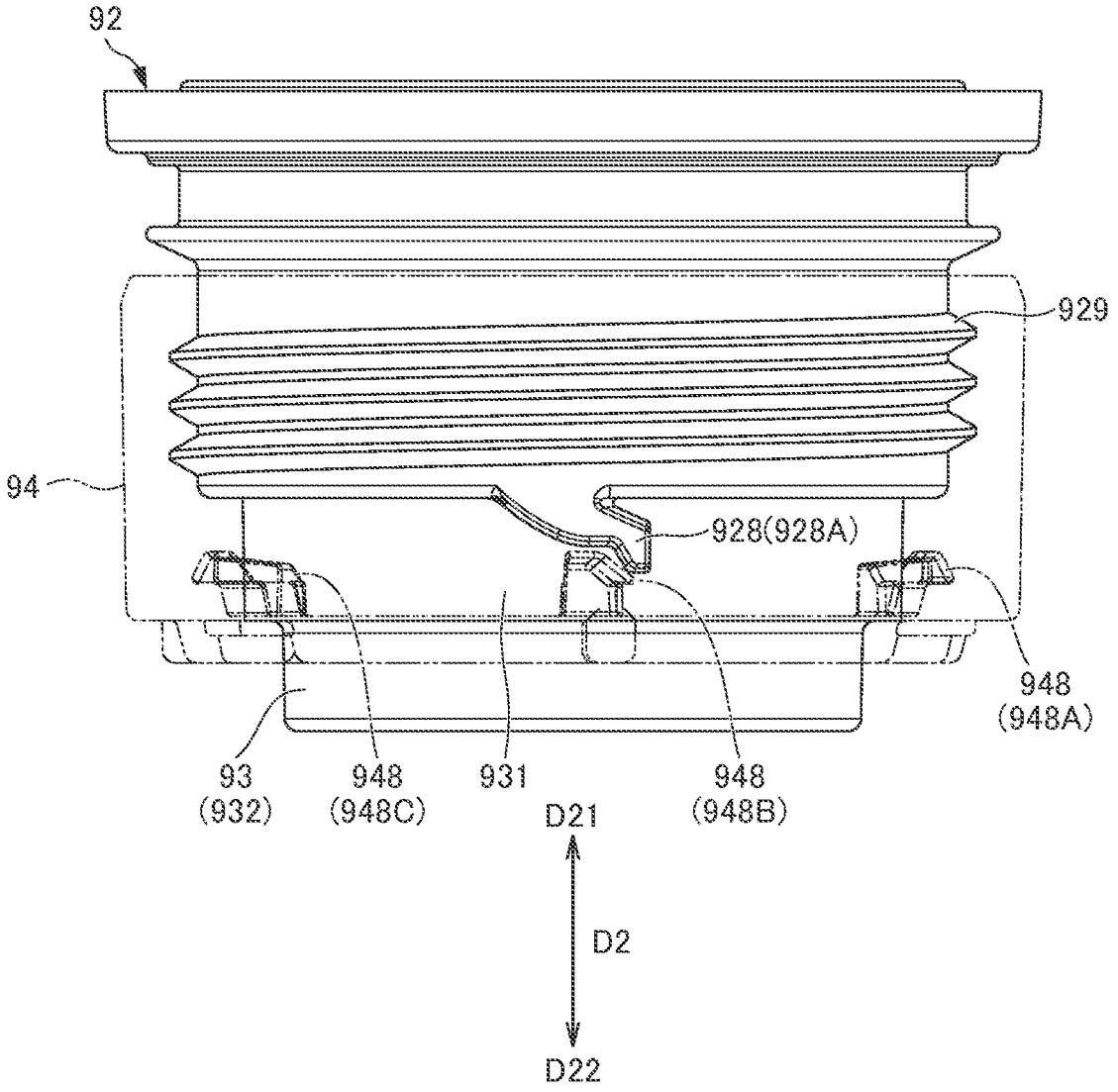
FIG. 13 is a partial transparent side view illustrating a second positional relationship between the inner housing portion 92 and the outer housing portion 94 of the exhaust filter unit 90 in the circumferential direction.

The exhaust filter unit 90 will be described in detail. FIG. 5 is a side cross-sectional view illustrating the exhaust filter unit 90 of the substrate storing container 1 according to the embodiment of the present invention. FIG. 6 is a lower perspective view illustrating the exhaust filter unit 90 of the substrate storing container 1 according to the embodiment of the present invention. FIG. 7 is an exploded perspective view illustrating the exhaust filter unit 90 of the substrate storing container 1 according to the embodiment of the present invention. FIG. 8 is a lower perspective view illustrating an inner housing portion 92 of the exhaust filter unit 90. FIG. 9 is a side view illustrating the inner housing portion 92 of the exhaust filter unit 90. FIG. 10 is a plan view illustrating an outer housing portion 94 of the exhaust filter unit 90. FIG. 11 is a side cross-sectional view illustrating the outer housing portion 94 taken along line B-B in FIG. 10. FIG. 12 is a partial transparent side view illustrating a first positional relationship between the inner housing portion 92 and the outer housing portion 94 of the exhaust filter unit 90 in a circumferential direction. FIG. 13 is a partial transparent side view illustrating a second positional relationship between the inner housing portion 92 and the outer housing portion 94 of the exhaust filter unit 90 in the circumferential direction.

As illustrated in FIGS. 5 to 11, the exhaust filter unit 90 has an inner opening forming portion 91 as an inner component, the inner housing portion 92, a nozzle portion 93, the outer housing portion 94, a filter 95, and an O-ring 99. They are separate bodies, each composed of independent components. A ventilation path 901 capable of allowing communication between the substrate storing space 27 and the space outside the container main body 2 is formed by a filter unit housing composed of the inner opening forming portion 91, the inner housing portion 92, the nozzle portion 93, and the outer housing portion 94. In the exhaust filter unit 90, it is possible to pass gas from the substrate storing space 27 to the space outside the container main body 2 via the filter 95.

As illustrated in FIG. 7, the inner opening forming portion 91 has a disc shape. As illustrated in FIG. 5, the middle part of the inner opening forming portion 91 has a circular projection portion 911 projecting in the upper direction D21. The circumferential part of the inner opening forming portion 91 includes a flat plate-like annular circumferential portion 912. As illustrated in FIG. 7, a large number of through-holes 906 are formed in the circular projection portion 911 radially from the center of the circular projection portion 911. The large number of through-holes 906 penetrate in the upper/lower direction D2, and constitute a part of the ventilation path 901. A concave portion 915 is formed on the lower face of the annular circumferential portion 912.

As illustrated in FIGS. 5 to 9, the inner housing portion 92 has an outer tubular portion 921, an end flange portion 922, an end plate-like portion 923, and an inner tubular portion 926. The outer tubular portion 921 has a cylindrical shape. The end plate-like portion 923 having a disc shape is integrally molded and connected to the upper end portion of the outer tubular portion 921. The inner housing portion 92 has a male thread portion 929 at a part disposed inside the outer housing portion 94. Specifically, the male thread portion 929 is threaded on the side face (outer peripheral face) of the outer tubular portion 921. The inner housing portion 92 is at least partially (part including the male thread portion 929) disposed inside the outer housing portion 94 and is fastened to the outer housing portion 94.

In the part of the side face of the outer tubular portion 921 that is above the male thread portion 929, a small flange portion 924 is provided by being integrally molded with the outer tubular portion 921. The end flange portion 922 is provided by being integrally molded with the outer tubular portion 921 in the upper end portion of the outer tubular portion 921 above the part of the outer tubular portion 921 where the small flange portion 924 exists. The end flange portion 922 has a convex portion 925 extending in the upper direction D21. The end flange portion 922 is fixed to the annular circumferential portion 912 by welding the convex portion 925 and the part of the annular circumferential portion 912 where the concave portion 915 is formed in the inner opening forming portion 91. That is, the inner opening forming portion 91 is joined to the inner housing portion 92 on the substrate storing space 27 side with the filter 95 sandwiched between them. Thus, the inner housing portion 92 is connected to the inner opening forming portion 91 with a positional relationship coaxial with the inner opening forming portion 91. The joining method is not limited to welding, and may be, for example, bonding.

As illustrated in FIGS. 8 to 13, the inner housing portion 92 has a plurality of first engagement portions 928 at a part that is disposed inside the outer housing portion 94 and where the male thread portion 929 does not exist (for example, a part that does not overlap in a radial direction). The first engagement portions 928 project on the lower side from the lower end portion of the outer tubular portion 921, and are provided so as to be separated from each other in a circumferential direction. In the present embodiment, two first engagement portions 928 are provided at substantially equal intervals. The first engagement portion 928 is shaped to easily pass over a second engagement portion 948 (described later) of the outer housing portion 94 when moving in the fastening direction, and to be difficult to pass over the second engagement portion 948 of the outer housing portion 94 when moving in the loosening direction.

The inner tubular portion 926 is disposed inward in the radial direction of the outer tubular portion 921, and extends downward from the end plate-like portion 923, and extends further downward than the lower end portion of the outer tubular portion 921. The inner tubular portion 926 are disposed in the space formed by the inner peripheral face of a tubular portion 941 (described later) of the outer housing portion 94, with a coaxial positional relationship with the tubular portion 941 of the outer housing portion 94. The inner tubular portion 926 and the outer tubular portion 921 form a double cylinder. The space outside the inner tubular portion 926 and inside the outer tubular portion 921 forms an annular space 927 that extends in the upper/lower direction D2.

A space 904 inside the inner tubular portion 926 is in communication with the through-holes 906, whereas the space outside the inner tubular portion 926 and inside the outer tubular portion 921 is not in communication with the through-holes 906. Accordingly, the space 904 inside the inner tubular portion 926 constitutes a part of the ventilation path 901.

The filter 95 has a disc shape. The circumferential portion of the filter 95 is fixed to the end flange portion 922 and the annular circumferential portion 912 with a positional relationship so as to be sandwiched between the end flange portion 922 of the inner housing portion 92 and the annular circumferential portion 912 of the inner opening forming portion 91. As a result, the filter 95 is disposed in the ventilation path 901. The filter 95 prevents particles or the like from passing through the through-holes 906 of the inner opening forming portion 91.

As illustrated in FIGS. 5 to 7, the nozzle portion 93 has a tubular portion 931 and an external projection portion 932. The tubular portion 931 has a cylindrical shape. The lower portion of the tubular portion 931 is connected to a bottom portion 934 by integral molding, and the bottom portion 934 is connected to the external projection portion 932 by integral molding. The tubular portion 931 is disposed so as to be fitted into the annular space 927 of the inner housing portion 92. The outer diameter of the upper portion of the tubular portion 931 is slightly smaller than the inner diameter of the outer tubular portion 921 of the inner housing portion 92.

The external projection portion 932 has a cylindrical shape with a short axial length. The outer diameter of the external projection portion 932 is smaller than that of the tubular portion 931, and the inner diameter of the external projection portion 932 is smaller than that of the tubular portion 931. A cylindrical through-hole is formed in the middle of the external projection portion 932. The through-hole constitutes an external space side opening 903. The inner diameter of the external space side opening 903 is slightly larger than the outer diameter of the lower end side of the inner tubular portion 926.

The part of the nozzle portion 93 that surrounds the external space side opening 903, i.e., the lower end portion of the external projection portion 932, projects in the lower direction D22 where the ventilation path 901 opens in the external space side opening 903.

As the material of the nozzle portion 93, for example, a resin such as polybutylene terephthalate or polyethylene, an elastomer such as polyethylene elastomer or polyolefin elastomer, or a rubber material such as silicon rubber or fluororubber can be used.

As illustrated in FIGS. 5 to 7, 10, and 11, the outer housing portion 94 has the tubular portion 941 and an end inward projection portion 942. The tubular portion 941 has a cylindrical shape. The inner diameter of the tubular portion 941 is larger than the outer diameter of the outer tubular portion 921 of the inner housing portion 92. Thus, the inner housing portion 92 is disposed in the space formed by the inner peripheral face of the tubular portion 941 of the outer housing portion 94, with a coaxial positional relationship with the tubular portion 941 of the outer housing portion 94.

The outer housing portion 94 has a female thread portion 949 that meshes with the male thread portion 929 of the inner housing portion 92. Specifically, the female thread portion 949 is threaded on the inner peripheral face of the tubular portion 941. The male thread portion 929 of the outer tubular portion 921 of the inner housing portion 92 is threaded to the female thread portion 949. Thus, the outer housing portion 94 is fastened and fixed to the inner housing portion 92. The end inward projection portion 942 is provided by being integrally molded with the lower end portion of the tubular portion 941. The end inward projection portion 942 projects inward in the radial direction of the tubular portion 941 from the lower end portion of the tubular portion 941, and has an annular plate shape. In the middle of the end inward projection portion 942, a cylindrical through-hole is formed. The through-hole constitutes an external space side opening 902. In the completed fastening state of the inner housing portion 92 and the outer housing portion 94, the nozzle portion 93 and the inner tubular portion 926 of the inner housing portion 92 project downward from the external space side opening 902. Rib portions 946 projecting toward the lower side from the end inward projection portion 942 are provided. Three rib portions 946 are formed at equal intervals in the circumferential direction of the tubular portion 941.

The outer housing portion 94 has a plurality of second engagement portions 948 that engage with the first engagement portions 928 of the inner housing portion 92 at a part where the female thread portion 949 does not exist (e.g., a part that does not overlap in a radial direction). The second engagement portions 948 are provided so as to project upward on the inner face (upper face) of the end inward projection portion 942, and are separated from each other in a circumferential direction. In the present embodiment, six second engagement portions 948 are provided at substantially equal intervals in the circumferential direction.

Figure 16:
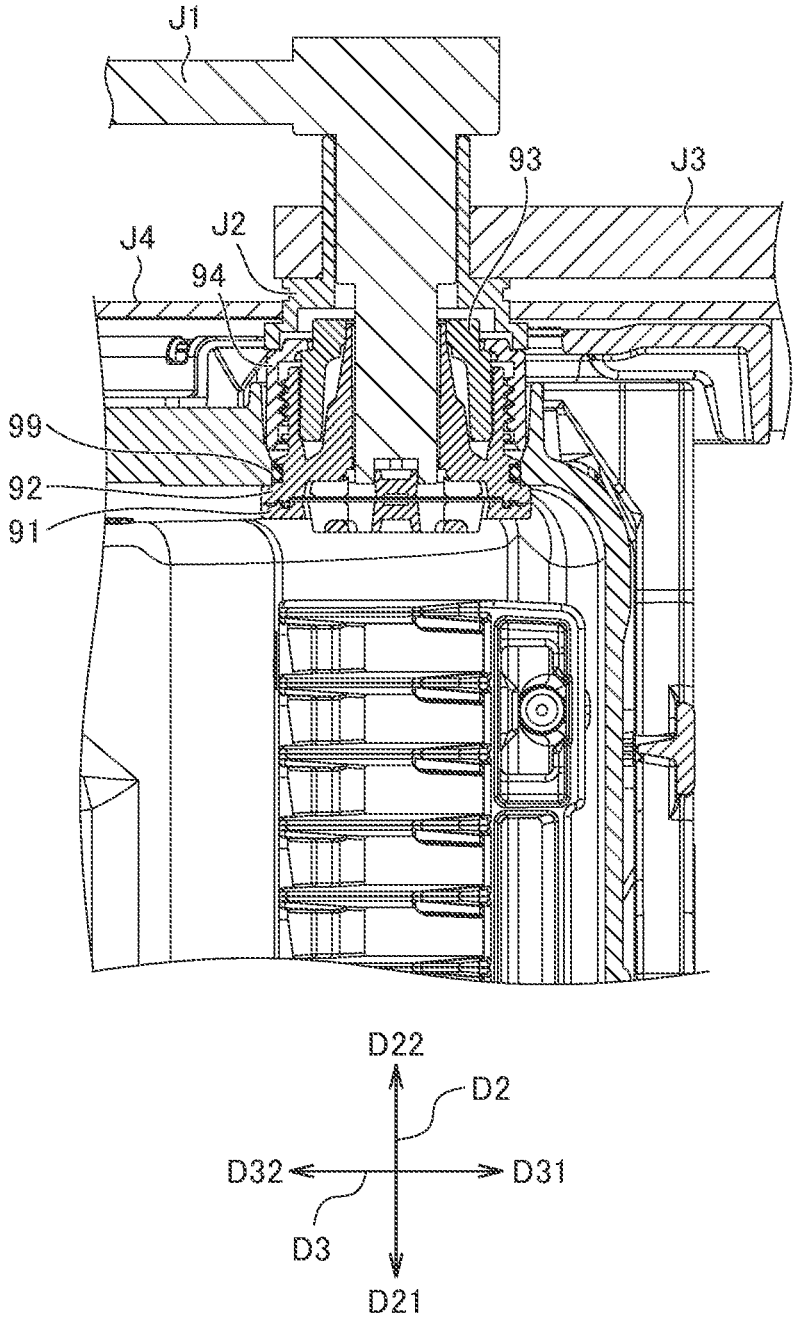
FIG. 16 is a cross-sectional view taken along line C-C in FIG. 15.

The inner housing portion 92 is fixed to the lower wall 24 via the O-ring 99 mounted in a groove formed on the side face of the inner housing portion 92 (groove formed between the end flange portion 922 and the small flange portion 924) (see FIG. 16). When the inner housing portion 92 is fixed to the lower wall 24, sealing is performed between the lower wall 24 and the nozzle portion 93 by the O-ring 99 being used between the inner housing portion 92 and the lower wall 24.

In the exhaust filter unit 90, the ventilation path 901 is formed by the inner opening forming portion 91, the inner housing portion 92, the nozzle portion 93, and the outer housing portion 94, which constitute the filter unit housing. More specifically, the ventilation path 901 continues from the through-holes 906 of the inner opening forming portion 91 to the space 904 inside the inner tubular portion 926 of the inner housing portion 92, to the external space side opening 903 of the nozzle portion 93, and to the external space side opening 902 of the outer housing portion 94.

[Engagement and Visual Identification of First Engagement Portions 928 and Second Engagement Portions 948]

The engagement and visual identification of the first engagement portions 928 of the inner housing portion 92 and the second engagement portions 948 of the outer housing portion 94 will be described. The inner housing portion 92 and the outer housing portion 94 behave and are fastened to each other in the following manner. Although the behavior of the fastening between the inner housing portion 92 and the outer housing portion 94 is due to the relative movement of the two portions, it is assumed here that the inner housing portion 92 is fixed and the outer housing portion 94 moves to the inner housing portion 92.

The nozzle portion 93 is caused to enclose the inner tubular portion 926 of the inner housing portion 92. Specifically, the tubular portion 931 of the nozzle portion 93 is inserted into the annular space 927, which is the space outside the inner tubular portion 926 of the inner housing portion 92 and inside the outer tubular portion 921. The outer housing portion 94 is fastened to the inner housing portion 92 in that state. Specifically, the female thread portion 949 of the outer housing portion 94 is threaded to the male thread portion 929 of the inner housing portion 92. As it is threaded, the outer housing portion 94 moves in the upper direction D21 and approaches the inner housing portion 92 while rotating with the upper/lower direction D2 as its rotation axis. Accordingly, the second engagement portions 948 of the outer housing portion 94 approach the first engagement portions 928 of the inner housing portion 92 in the upper/lower direction D2 and butt against the first engagement portions 928 in a circumferential direction (rotational direction).

Even after butting, when the rotation of the outer housing portion 94 is continued, the second engagement portions 948 sequentially pass over the first engagement portions 928. After passing over, the first engagement portions 928 and the second engagement portions 948 can be engaged with each other. Since the amount of fastening torque of the outer housing portion 94 is controlled (set), the second engagement portions 948 repeat passing over the first engagement portions 928 until the maximum amount of torque is reached within the range not exceeding the set specified amount of torque. Then, the positional relationship between the first engagement portions 928 and the second engagement portions 948 where the final passing over occurs is the specified normal (completed) fastening position, i.e., the completed engagement position (position where strong engagement is achieved).

Here, for example, as illustrated in FIGS. 10 and 12, the normal (proper) (completed) fastening position shall be the state where one first engagement portion 928A is disposed between a second engagement portion 948B (upstream) and a second engagement portion 948C (downstream), which are adjacent to each other in the circumferential direction. In the process of fastening, the first engagement portion 928A may not be disposed between the second engagement portion 948B and the second engagement portion 948C (not in the normal fastening position) due to some defects (for example, when the set torque of the torque wrench was set incorrectly low, or when the first engagement portion 928A has bitten the upstream second engagement portion 948B). Further, although the first engagement portion 928A is once disposed between the second engagement portion 948B and the second engagement portion 948C (once disposed in a normal fastening position), as illustrated in FIG. 13, the first engagement portion 928A may be disposed between the second engagement portion 948B and an upstream second engagement portion 948A (which is shifted from the normal fastening position) for some reason (e.g., when the outer housing portion 94 is unintentionally rotated in the loosening direction). In FIGS. 12 and 13, the outer housing portion 94 is indicated by a two-dot chain line (imaginary line). However, it is difficult to confirm whether the fastening position is normal.

In the present embodiment, in fastening of the inner housing portion 92 and the outer housing portion 94, the first engagement portions 928 and the second engagement portions 948 are configured to be visually identifiable. In particular, the outer housing portion 94 is configured to allow visual identification of the first engagement portions 928 and the second engagement portions 948 in a range that includes the second engagement portions 948 and that is a circumferential range around the rotation axis of the female thread portion 949.

For example, when the outer housing portion 94 is opaque, since the inside of the outer housing portion 94 cannot be seen from the outside of the outer housing portion 94, it is impossible to visually identify the first engagement portions 928 and the second engagement portions 948. Further, when both the inner housing portion 92 and the outer housing portion 94 are transparent and are the same in color and transparency, it is difficult to visually identify the first engagement portions 928 and the second engagement portions 948. In contrast, in the embodiment of the present invention, the tubular portion 941 of the outer housing portion 94 is transparent or translucent. The second engagement portions 948 of the outer housing portion 94 are visually identifiable by being colored or less transparent, relative to the transparent or translucent tubular portion 941. The first engagement portions 928 of the inner housing portion 92 is easily visually identifiable by having a different color (red, green, blue, or the like) or transparency from the second engagement portions 948 of the outer housing portion 94.

[Air Supply Filter Unit 80]

The air supply filter unit 80 is capable of passing gas from the space outside the container main body 2 to the substrate storing space 27 via a filter (not illustrated). The air supply filter unit 80 is obtained by changing the configuration for exhausting gas of the exhaust filter unit 90 to the configuration for intaking gas, and the basic configuration is the same. Accordingly, a specific description is omitted.

[Substrate Support Plate-Like Portion 5]

As illustrated in FIG. 2 and so on, the substrate support plate-like portions 5 are provided in the first side wall 25 and the second side wall 26 so as to make a pair in the left/right direction D3 in the substrate storing space 27 in the container main body 2. Specifically, as illustrated in FIG. 4 and so on, the substrate support plate-like portion 5 has plate portions 51.

The plate portion 51 has a plate-like substantially arc shape. Twenty-five plate portions 51 are provided in each of the first side wall 25 and the second side wall 26 in the upper/lower direction D2, i.e., a total of 50 plate portions are provided. The adjacent plate portions 51 are separated from each other at an interval of 10 mm to 12 mm in the upper/lower direction D2 and arranged in parallel.

The 25 plate portions 51 provided in the first side wall 25 and the 25 plate portions 51 provided in the second side wall 26 face each other in the left/right direction D3. A convex portion is provided on the upper face of the plate portion 51. The substrate W supported by the plate portion 51 is in contact only with the projecting end of the convex portion, and is not in contact with the face of the plate portion 51.

The substrate support plate-like portions 5 having such a configuration are capable of supporting the edge portions of the plurality of substrate W in a state where the adjacent substrates W are separated from each other at a predetermined interval and arranged in parallel.

[Back Side Substrate Support Portion 6]

As illustrated in FIG. 4, the back side substrate support portion 6 has back side end edge support portions 60. The back side end edge support portions 60 are integrally molded with the container main body 2 in the rear end portions of the plate portions 51 of the substrate support plate-like portions 5.

The number of the back side end edge support portions 60 corresponds to the number of the substrates W that can be stored in the substrate storing space 27, specifically, 25 back side end edge support portions 60 are provided. The back side end edge support portions 60 disposed in the first side wall 25 and the second side wall 26 have a positional relationship that makes a pair with the front retainer described later in the forward/backward direction D1. The substrates W are stored in the substrate storing space 27, the lid body 3 is closed, and then the back side end edge support portions 60 support the end edges of the edge portions of the substrates W.

[Lid Body 3]

As illustrated in FIG. 1, the lid body 3 has a substantially rectangular shape that substantially matches the shape of the opening circumferential portion 28 of the container main body 2. The lid body 3 can be attached to and detached from the opening circumferential portion 28 of the container main body 2. The container main body opening portion 21 can be blocked by the lid body 3 by the lid body 3 being mounted in the opening circumferential portion 28, with a positional relationship in which the lid body 3 is surrounded by the opening circumferential portion 28.

An annular sealing member 4 is attached to the inner face of the lid body 3 (rear face of the lid body 3 illustrated in FIG. 1) so as to go around the outer circumferential edge portion of the lid body 3. The face faces a face (sealing face 281) of the step part formed at a position directly behind (backward direction D12) the opening circumferential portion 28 at a time when the lid body 3 blocks the container main body opening portion 21. The sealing member 4 is disposed so as to go around the lid body 3. The sealing member 4 is made of various types of elastically deformable thermoplastic elastomers such as polyester-based elastomers and polyolefin-based elastomers, fluororubber, silicon rubber, or the like.

When the lid body 3 is mounted in the opening circumferential portion 28, the sealing member 4 is elastically deformed by being sandwiched between the sealing face 281 (see FIG. 1) of the container main body 2 and the inner face of the lid body 3. In other words, with the sealing member 4 interposed between lid body 3 and the container main body 2, the lid body 3 can block the container main body opening portion 21 in a state where the lid body 3 and the opening circumferential portion 28 do not abut against each other and are separated from each other. By the lid body 3 being removed from the opening circumferential portion 28, the substrate W can be taken in and out of the substrate storing space 27 in the container main body 2.

The lid body 3 is provided with a latch mechanism. The latch mechanism is provided near both right and left end portions of the lid body 3. As illustrated in FIG. 1, the latch mechanism is provided with two upper side latch portions 32A and 32A capable of projecting upward from the upper side of the lid body 3 and two lower side latch portions 32B and 32B capable of projecting downward from the lower side of the lid body 3. The lower side latch portions 32B and 32B are illustrated in FIG. 1 by breaking off portions of the lid body 3. The two upper side latch portions 32A and 32A are disposed near both right and left ends of the upper side of the lid body 3. The two lower side latch portions 32B and 32B are disposed near both right and left ends of the lower side of the lid body 3.

An operation portion 33 is provided on the outer face of the lid body 3. By operating the operation portion 33 from the front side of the lid body 3, it is possible to cause the upper side latch portions 32A and 32A and the lower side latch portions 32B and 32 B to project from the upper and lower sides of the lid body 3 and cause the upper side latch portions 32A and 32A and the lower side latch portions 32B and 32 B not to project from the upper and lower sides. The upper side latch portions 32A and 32A are engaged with the latch engagement concave portions 231A and 231B of the container main body 2 by projecting upward from the upper side of the lid body 3 and the lower side latch portions 32B and 32B are engaged with the latch engagement concave portions 241A and 241B of the container main body 2 by projecting downward from the lower side of the lid body 3. As a result, the lid body 3 is fixed to the container main body opening portion 21 of the container main body 2.

A concave portion (not illustrated) concaved outward (forward direction D11) from the substrate storing space 27 is formed on the inner side (side of backward direction D12 of the lid body 3 in FIG. 1) of the lid body 3. The front retainer (not illustrated) is fixedly provided in the concave portion (not illustrated).

The front retainer (not illustrated) has front retainer substrate receiving portions (not illustrated). The front retainer substrate receiving portions (not illustrated) are disposed two by two so as to make a pair and at a predetermined interval in the left/right direction. The front retainer substrate receiving portions disposed two by two so as to make a pair as described above are provided in a state where 25 pairs are arranged in parallel in the upper/lower direction. The front retainer substrate receiving portions support the end edge of the edge portion of the substrate W by the substrate W being stored in the substrate storing space 27 and the lid body 3 being closed.

[Method for Manufacturing Substrate Storing Container 1]

Figure 14:
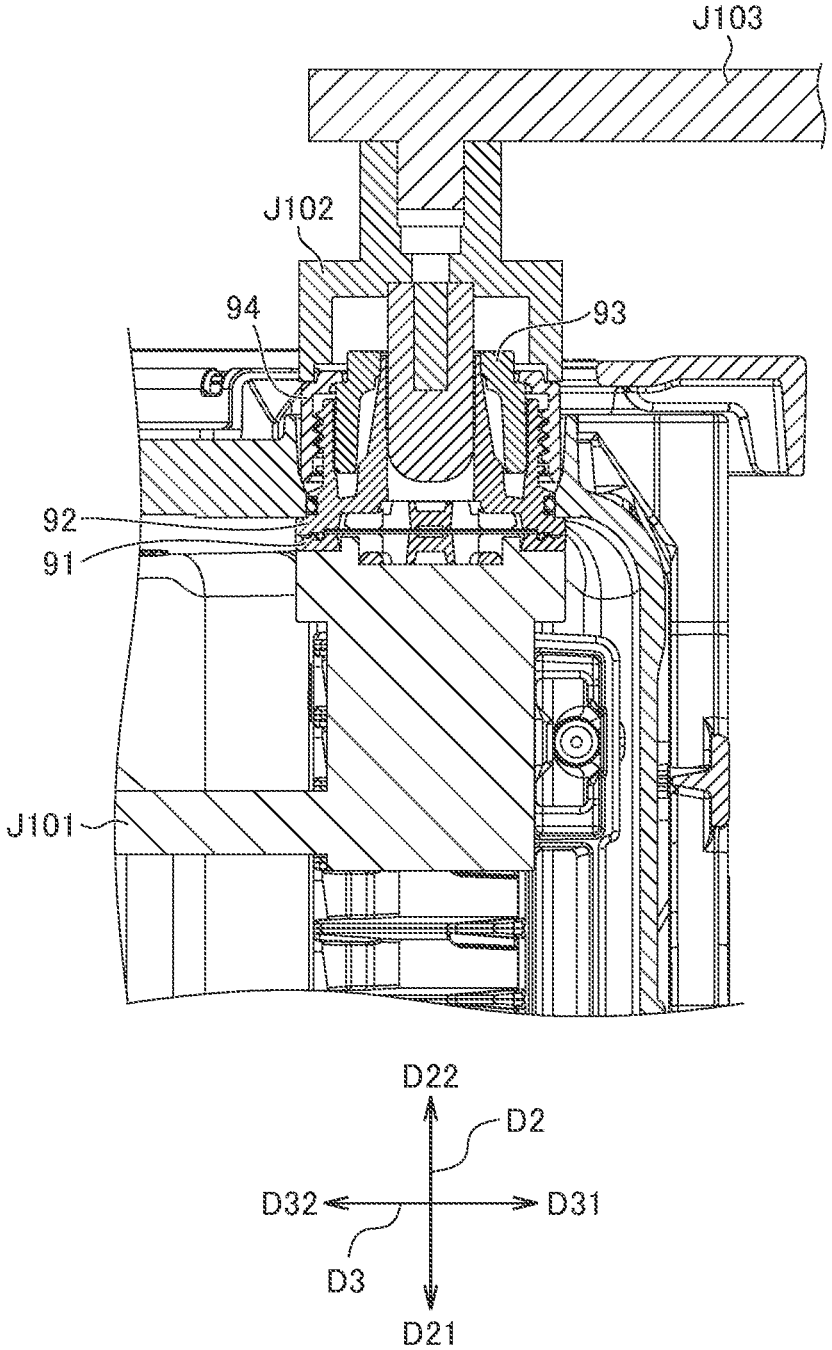
FIG. 14 is a partial forward cross-sectional view illustrating a conventional manufacturing method.
Figure 15:
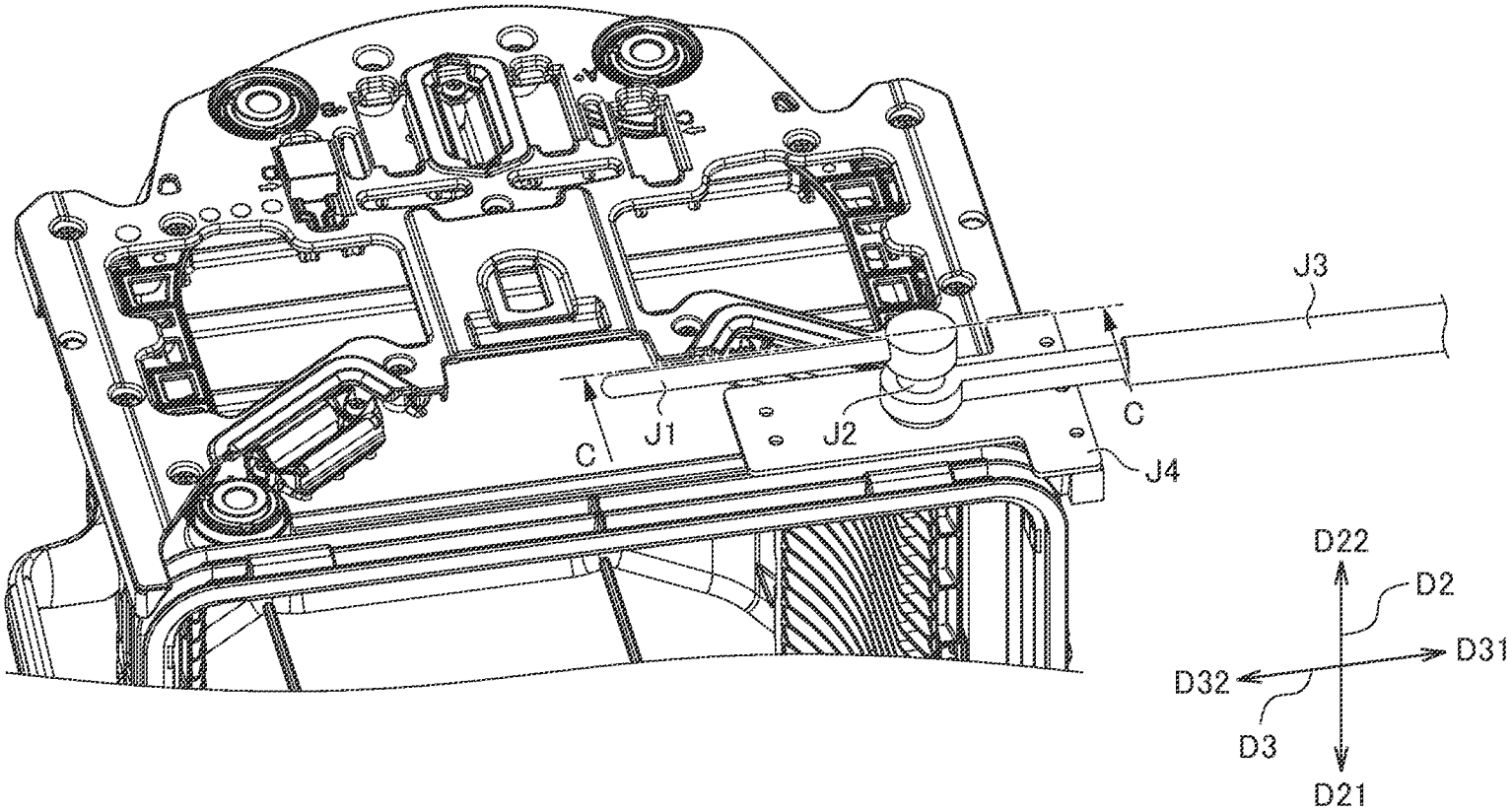
FIG. 15 is an upper perspective view illustrating an embodiment of a manufacturing method of the present invention.

An embodiment of a manufacturing method of the present invention will be described. FIG. 14 is a partial forward cross-sectional view illustrating a conventional manufacturing method. FIG. 15 is an upper perspective view illustrating the embodiment of the manufacturing method of the present invention. FIG. 16 is a cross-sectional view taken along line C-C in FIG. 15. Prior to the description of the embodiment of the manufacturing method of the present invention, a conventional manufacturing method will be described. In FIGS. 14 to 16, the container main body 2 is illustrated with the lower direction D22 facing upward and the upper direction D21 facing downward.

As illustrated in FIG. 14, in the conventional manufacturing method, the inner opening forming portion 91 that is joined to the inner housing portion 92 is fixed by a fixing jig J101 from the upper direction D21 side. In that state, the outer housing portion 94 is fastened to the inner housing portion 92 with a torque wrench J103 via a fastening jig J102. In such a fastening method, a load is applied to the joining (welding) part between the inner housing portion 92 and the inner opening forming portion 91, the joining part will be broken, and thus it may not be possible to complete the fastening.

In contrast, in the embodiment of the manufacturing method of the present invention, the inner housing portion 92 and the outer housing portion 94 are fastened to each other by rotating the outer housing portion 94 with the inner housing portion 92 fixed. Accordingly, the outer housing portion 94 can be fastened to the inner housing portion 92 without applying a load to the joining part between the inner housing portion 92 and the inner opening forming portion 91. Specifically, as illustrated in FIGS. 15 and 16, the inner housing portion 92 is fixed with a fixing jig J1 from the lower direction D22 side. In that state, the outer housing portion 94 is fastened to the inner housing portion 92 with a torque wrench J3 via a fastening jig J2. In this fastening method, no load is applied to the joining part between the inner housing portion 92 and the inner opening forming portion 91, and thus the joining part is not broken. A reinforcing jig J4 is a jig for preventing the outer housing portion 94 from being loaded more than necessary during fastening.

[Effects of the Embodiment]

According to the substrate storing container 1 according to the present embodiment having the above configuration, the following effects can be obtained. The substrate storing container 1 according to the present embodiment includes the outer housing portion 94 and the inner housing portion 92 at least partially disposed inside the outer housing portion 94 and fastened to the outer housing portion 94. The inner housing portion 92 has the male thread portion 929 at a part disposed inside the outer housing portion 94. The outer housing portion 94 has the female thread portion 949 that meshes with the male thread portion 929. The inner housing portion 92 has the first engagement portions 928 at a part that is disposed inside the outer housing portion 94 and where the male thread portion 929 does not exist. The outer housing portion 94 has the second engagement portions 948 that engages with the first engagement portions 928 at a part where the female thread portion 949 does not exist. In fastening of the inner housing portion 92 and the outer housing portion 94, the first engagement portion 928 and the second engagement portion 948 are configured to be visually identifiable.

Accordingly, according to the substrate storing container 1 of the present embodiment, the first engagement portions 928 and the second engagement portions 948 can be visually identifiable in fastening of the inner housing portion 92 and the outer housing portion 94 without being obstructed by the existence of the male thread portion 929 of the inner housing portion 92 and the female thread portion 949 of the outer housing portion 94. Accordingly, it is possible to easily confirm (grasp) that the first engagement portion 928 and the second engagement portion 948 are not disposed with the normal positional relationship (are not disposed at the normal completed fastening positions) and the normal fastening is not performed.

Further, in the present embodiment, the outer housing portion 94 is configured such that the first engagement portions 928 and the second engagement portions 948 are visually identifiable in a range that includes the second engagement portions 948 and that is a circumferential range around the rotation axis of the female thread portion 949. Accordingly, even when the first engagement portion 928 and the second engagement portion 948 are not engaged, the positional relationship between the first engagement portion 928 and the second engagement portion 948 can be easily grasped visually.

In the method for manufacturing the substrate storing container 1 according to the present embodiment, the inner housing portion 92 and the outer housing portion 94 are fastened to each other by rotating the outer housing portion 94 with the inner housing portion 92 fixed. Accordingly, the outer housing portion 94 can be fastened to the inner housing portion 92 without applying a load to the joining part between the inner housing portion 92 and the inner opening forming portion 91.

[Modification]

The present invention is not limited to the embodiment described above and can be modified within the technical scope described in the claims.

For example, the configurations of the components of the substrate storing container and the exhaust filter unit of the present invention are not limited to the configurations of the components of the substrate storing container 1 and the exhaust filter unit 90 in the present embodiment. In the present embodiment, the exhaust filter unit 90 has a configuration in which "the first engagement portions and the second engagement portions are visually identifiable", which is one of the features of the present invention, but the present invention is not limited to this feature. The air supply filter unit 80 and/or the exhaust filter unit 90 may have the above feature of the present invention.

In the present embodiment, the inner housing portion 92 is of the same color and transparency as a whole including the first engagement portions 928, and the outer housing portion 94 is of the same color and transparency as a whole including the second engagement portions 948, but the present invention is not limited thereto. In the inner housing portion 92, the first engagement portions 928 can be made to have a color and transparency different from those of the other parts by two-color molding or the like. Similarly, in the outer housing portion 94, the second engagement portions 948 can be made to have a color and transparency different from those of the other parts.

The shapes of the container main body and the lid body, the number and dimensions of the substrates that can be stored in the container main body of the present invention are not limited to the shapes of the container main body 2 and the lid body 3 and the number and dimensions of the substrates W that can be stored in the container main body 2 in the present embodiment. The substrate W in the present embodiment is a silicon wafer having a diameter of 300 mm, but the present invention is not limited to this value.

In the present embodiment, the back side substrate support portion has a back side end edge support portion 60 integrally molded with the container main body 2 in the rear end portion of the plate portion 51 of the substrate support plate-like portion 5, but the present invention is not limited to this configuration. For example, the back side substrate support portion may not be integrally molded with the container main body but may be separated from the container main body.

In the present embodiment, the two through-holes in the front of the lower wall 24 are exhaust holes 243 for discharging the gas in the container main body 2 and the two through-holes in the back of the lower wall 24 are air supply holes for supplying gas into the container main body 2, but the present invention is not limited to this configuration. For example, at least one of the two through-holes in the front of the lower wall may be an air supply hole for supplying gas into the container main body.

EXPLANATION OF REFERENCE NUMERALS

1 substrate storing container
2 container main body
20 wall portion
21 container main body opening portion
27 substrate storing space
28 opening circumferential portion
3 lid body
4 sealing member
90 exhaust filter unit (filter unit)
91 inner opening forming portion (inner component, a part of housing)
92 inner housing portion (a part of housing)
93 nozzle portion (a part of housing)
94 outer housing portion (a part of housing)
95 filter
901 ventilation path
928 first engagement portion
929 male thread portion
948 second engagement portion
949 female thread portion
W substrate

The invention claimed is:

1. A substrate storing container, comprising:

a container main body including a tubular wall portion in which an opening circumferential portion with a container main body opening portion formed is provided in one end portion and the other end portion is blocked, an inner face of the wall portion forming a substrate storing space that can store a substrate and communicates with the container main body opening portion;

a lid body that can be attached to and detached from the opening circumferential portion and can block the container main body opening portion with a positional relationship surrounded by the opening circumferential portion;

a sealing member attached to the lid body and capable of abutting against the lid body and the opening circumferential portion, the sealing member blocking the container main body opening portion in cooperation with the lid body by being interposed between the opening circumferential portion and the lid body and coming into close contact with and abutting against the opening circumferential portion and the lid body; and a filter unit having: a ventilation path capable of allowing communication between the substrate storing space and a space outside the container main body, a filter disposed in the ventilation path, and a housing that forms the ventilation path, the filter unit being disposed in the container main body, wherein gas can pass between the space outside the container main body and the substrate storing space through the filter, the housing comprising a transparent or translucent outer housing portion, and an inner housing portion that is fastened to the outer housing portion and that is at least partially disposed inside the outer housing portion in a fastening state of the outer housing portion and the inner housing portion, the inner housing portion having a male thread portion at a part disposed inside the outer housing portion in the fastening state of the outer housing portion and the inner housing portion, the outer housing portion having a female thread portion that meshes with the male thread portion, the inner housing portion having a first engagement portion at a part that is disposed inside the outer housing portion in the fastening state of the outer housing portion and the inner housing portion and where the male thread portion does not exist, the outer housing portion having a second engagement portion at a part where the female thread portion does not exist inside the outer housing portion in the fastening state of the outer housing portion and the inner housing portion, the second engagement portion engaging with the first engagement portion in a circumferential direction, and the first engagement portion and the second engagement portion are configured to be visually identifiableby having different colors or transparencies from each other in fastening of the inner housing portion and the outer housing portion.

2. The substrate storing container according to claim 1, wherein the outer housing portion is configured such that the first engagement portion and the second engagement portion are visually identifiable in a range that includes the second engagement portion and that is a circumferential range around a rotation axis of the female thread portion.

3. The substrate storing container according to claim 1, the housing further comprising an inner component joined to the inner housing portion on a side of the substrate storing space with the filter sandwiched between them, and the inner housing portion and the outer housing portion being fastened to each other by rotating the outer housing portion with the inner housing portion fixed.

4. A filter unit disposed in a container main body of a substrate storing container, the substrate storing container comprising:

the container main body including a tubular wall portion in which an opening circumferential portion with a container main body opening portion formed is provided in one end portion and the other end portion is blocked, an inner face of the wall portion forming a substrate storing space that can store a substrate and communicates with the container main body opening portion;

a lid body that can be attached to and detached from the opening circumferential portion and can block the container main body opening portion with a positional relationship surrounded by the opening circumferential portion; and a sealing member attached to the lid body and capable of abutting against the lid body and the opening circumferential portion, the sealing member blocking the container main body opening portion in cooperation with the lid body by being interposed between the opening circumferential portion and the lid body and coming into close contact with and abutting against the opening circumferential portion and the lid body, the filter unit having: a filter disposed in a ventilation path capable of allowing communication between the substrate storing space and a space outside the container main body, and a housing that forms the ventilation path, the filter unit being disposed in the container main body, wherein gas can pass between the space outside the container main body and the substrate storing space through the filter, the housing comprising a transparent or translucent outer housing portion, and an inner housing portion that is fastened to the outer housing portion and that is at least partially disposed inside the outer housing portion in a fastening state of the outer housing portion and the inner housing portion, the inner housing portion having a male thread portion at a part disposed inside the outer housing portion in the fastening state of the outer housing portion and the inner housing portion, the outer housing portion having a female thread portion that meshes with the male thread portion, the inner housing portion having a first engagement portion at a part that is disposed inside the outer housing portion in the fastening state of the outer housing portion and the inner housing portion and where the male thread portion does not exist, the outer housing portion having a second engagement portion at a part where the female thread portion does not exist inside the outer housing portion in the fastening state of the outer housing portion and the inner housing portion, the second engagement portion engaging with the first engagement portion in a circumferential direction, and the first engagement portion and the second engagement portion are configured to be visually identifiable by having different colors or transparencies from each other in fastening of the inner housing portion and the outer housing portion.

5. The filter unit according to claim 4, wherein the outer housing portion is configured such that the first engagement portion and the second engagement portion are visually identifiable in a range that includes the second engagement portion and that is a circumferential range around a rotation axis of the female thread portion.

* * * * *